US006612687B2

(12) United States Patent
Silverbrook

(10) Patent No.: US 6,612,687 B2
(45) Date of Patent: Sep. 2, 2003

(54) MOVING NOZZLE INK JET PRINTING MECHANISM

(75) Inventor: Kia Silverbrook, Balmain (AU)

(73) Assignee: Silverbrook Research Pty Ltd

( * ) Notice: Subject to any disclaimer, the term of this patent is extended or adjusted under 35 U.S.C. 154(b) by 0 days.

(21) Appl. No.: 09/798,408

(22) Filed: Mar. 2, 2001

(65) Prior Publication Data

US 2001/0007461 A1 Jul. 12, 2001

Related U.S. Application Data

(63) Continuation-in-part of application No. 09/112,821, filed on Jul. 10, 1998.

(30) Foreign Application Priority Data

Jun. 8, 1998 (AU) ..... PP3983

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS 6,299,291 B1 * 10/2001 Marusak ..... 347/54

FOREIGN PATENT DOCUMENTS

JP 401108050 A 4/1989

* cited by examiner

*Primary Examiner*—Raquel Yvette Gordon

(57) ABSTRACT

An ink jet nozzle assembly includes a nozzle chamber having an inlet to receive ink from a reservoir and a nozzle through which the ink can be ejected. The chamber includes a fixed portion and movable portion configured such that relative movement in an ejection phase reduces an effective volume of the chamber, and alternate relative movement in a refill phase enlarges the effective volume of the chamber. An actuator connected with the movable portion of the chamber periodically effects the relative movement. The nozzle is formed in the movable portion and the inlet is positioned and dimensioned relative to the nozzle such that ink is ejected preferentially from the chamber through the nozzle in droplet form in the ejection phase, and ink is alternately drawn preferentially into the chamber from the reservoir through the inlet in the refill phase.

9 Claims, 36 Drawing Sheets

MOVING NOZZLE INK JET PRINTING MECHANISM

This is a C-I-P of application Ser. No. 09/112,821 file on Jul. 10, 1998.

FIELD OF THE INVENTION

The present invention relates to the operation and construction of an ink jet printer device and, in particular, discloses a coil actuated magnetic plate ink jet printer.

BACKGROUND OF THE INVENTION

Many different types of printing have been invented, a large number of which are presently in use. The known forms of printers have a variety of methods for marking the print media with a relevant marking media. Commonly used forms of printing include offset printing, laser printing and copying devices, dot matrix type impact printers, thermal paper printers, film recorders, thermal wax printers, dye sublimation printers and ink jet printers both of the drop on demand and continuous flow type. Each type of printer has its own advantages and problems when considering cost, speed, quality, reliability, simplicity of construction and operation etc.

In recent years, the field of ink jet printing, wherein each individual pixel of ink is derived from one or more ink nozzles has become increasingly popular primarily due to its inexpensive and versatile nature.

Many different techniques of ink jet printing have been invented. For a survey of the field, reference is made to an article by J Moore, "Non-Impact Printing: Introduction and Historical Perspective", Output Hard Copy Devices, Editors R Dubeck and S Sherr, pages 207–220 (1988).

Ink Jet printers themselves come in many different types. The utilisation of a continuous stream ink in ink jet printing appears to date back to at least 1929 wherein U.S. Pat. No. 1,941,001 by Hansell discloses a simple form of continuous stream electro-static ink jet printing.

U.S. Pat. No. 3,596,275 by Sweet also discloses a process of a continuous ink jet printing including the step wherein the ink jet stream is modulated by a high frequency electrostatic field so as to cause drop separation This technique is still utilized by several manufacturers including Elmjet and Scitex (see also U.S. Pat. No. 3,373,437 by Sweet et al)

Piezoelectric ink jet printers are also one form of commonly utilized ink jet printing device. Piezoelectric systems are disclosed by Kyser et. al. in U.S. Pat. No. 3,946,398 (1970) which utilizes a diaphragm mode of operation, by Zolten in U.S. Pat. No. 3,683,212 (1970) which discloses a squeeze mode of operation of a piezoelectric crystal, Stemme in U.S. Pat. No. 3,747,120 (1972) discloses a bend mode of piezoelectric operation, Howkins in U.S. Pat. No. 4,459,601 discloses a piezoelectric push mode actuation of the ink jet stream and Fischbeck in U.S. Pat. No. 4,584,590 which discloses a shear mode type of piezoelectric transducer element.

Recently, thermal ink jet printing has become an extremely popular form of ink jet printing. The ink jet printing techniques include those disclosed by Endo et al in GB 2007162 (1979) and Vaught et al in U.S. Pat. No. 4,490,728. Both the aforementioned references disclosed ink jet printing techniques rely upon the activation of an electrothermal actuator which results in the creation of a bubble in a constricted space, such as a nozzle, which thereby causes the ejection of ink from an aperture connected to the confined space onto a relevant print media. Printing devices utilizing the electro-thermal actuator are manufactured by manufacturers such as Canon and Hewlett Packard.

As can be seen from the foregoing, many different types of printing technologies are available. Ideally, a printing technology should have a number of desirable attributes. These include inexpensive construction and operation, high speed operation, safe and continuous long term operation etc. Each technology may have its own advantages and disadvantages in the areas of cost, speed, quality, reliability, power usage, simplicity of construction operation, durability and consumables.

SUMMARY OF THE INVENTION

The present invention provides an ink jet nozzle assembly formed on a substrate and including a nozzle chamber having a nozzle through which ink from the chamber can be ejected, the nozzle being situated on a portion of the chamber that moves relative to the substrate when the assembly is activated in use.

The present invention further provides an ink jet nozzle assembly including:

- a nozzle chamber having an inlet in fluid communication with an ink reservoir and a nozzle through which ink from said chamber can be ejected;
- the chamber including a fixed portion and a movable portion configured such that relative movement in an ejection phase reduces an effective volume of the chamber, and alternate relative movement in a refill phase enlarges the effective volume of the chamber;
- an actuator connected with the movable portion of the chamber and periodically effecting said relative movement;
- the nozzle being formed in the movable portion and the inlet being positioned and dimensioned relative to the nozzle, such that ink is ejected preferentially from the chamber through the nozzle in droplet form in the ejection phase, and ink is alternately drawn preferentially into the chamber from the reservoir through the inlet in the refill phase.

Preferably the fixed portion is mounted on a substrate.

Preferably the actuator is interposed between the substrate or the fixed portion of the chamber and the movable portion of the chamber.

Preferably an inlet passage extends between the inlet and the ink reservoir.

Preferably the inlet passage includes flow restriction means to enhance the preferential ejection of ink from the chamber during the ejection phase in response to the relative movement of the nozzle.

Preferably: the flow restriction means includes a region of reduced effective cross-sectional area relative to the chamber.

Preferably the flow restriction means include wall friction in the inlet passage.

Preferably the ink jet nozzle is manufactured using micro-electro-mechanical-systems (MEMS) techniques.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

In the preferred embodiment, an ink jet print head is constructed from a series of nozzle arrangements where each nozzle arrangement includes a magnetic plate actuator which is actuated by a coil which is pulsed so as to move the magnetic plate and thereby cause the ejection of ink. The movement of the magnetic plate results in a leaf spring device being extended resiliently such that when the coil is deactivated, the magnetic plate returns to a rest position resulting in the ejection of a drop of ink from an aperture created within the plate.

Figure 1:
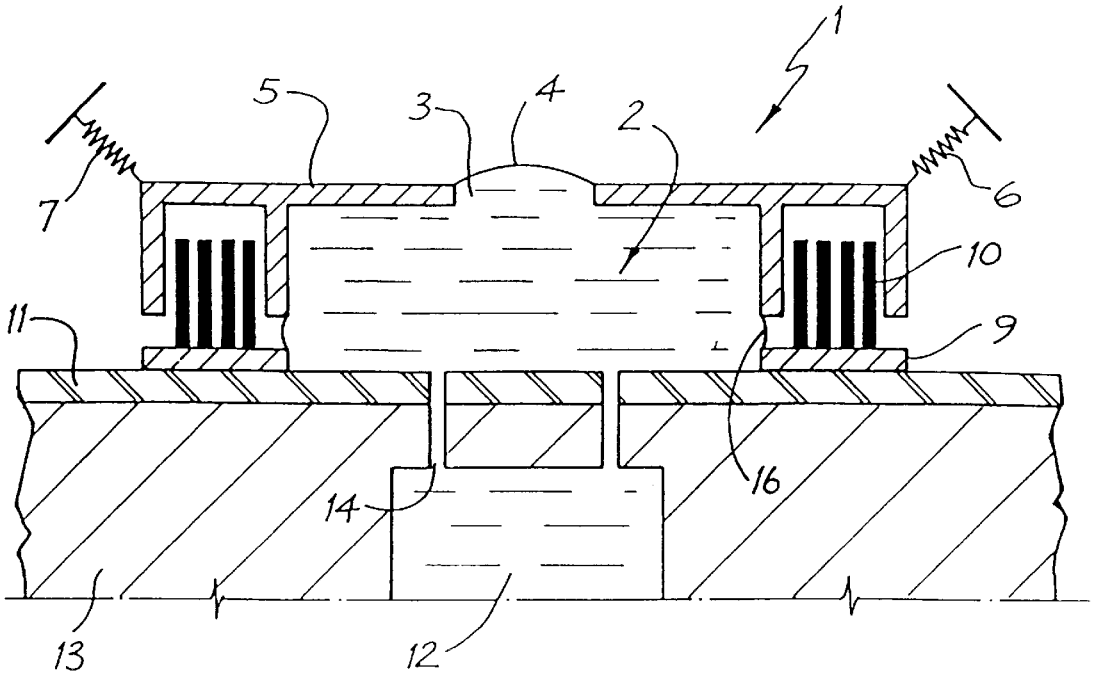
FIG. 1 to FIG. 3 to are schematic illustrations of the operation of an ink jet nozzle arrangement of an embodiment.
Figure 2:
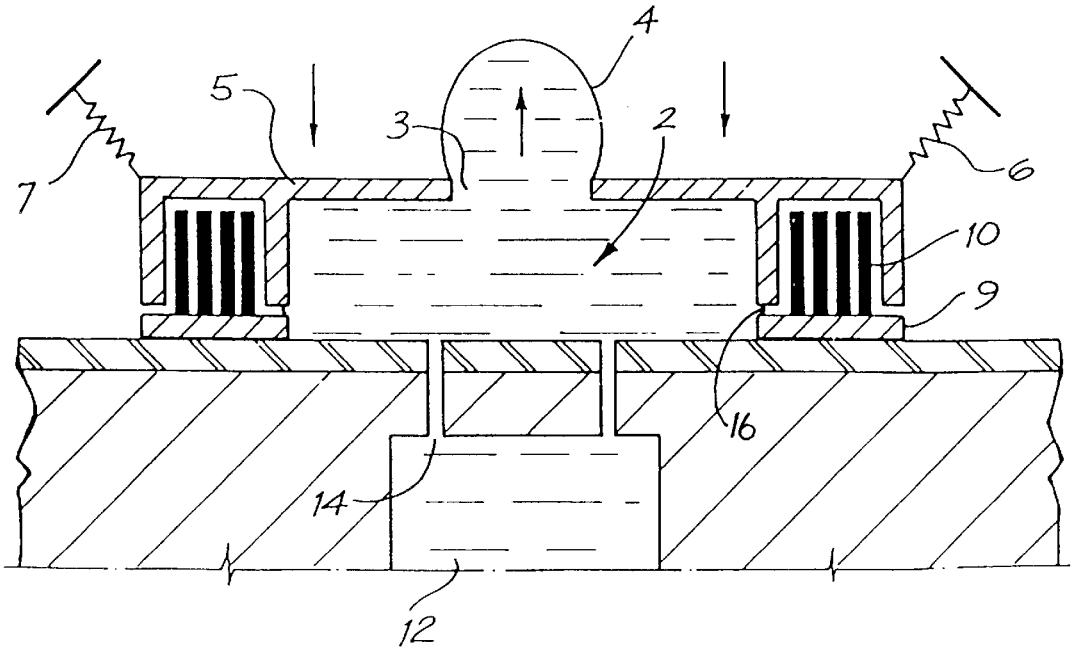
Figure 3:
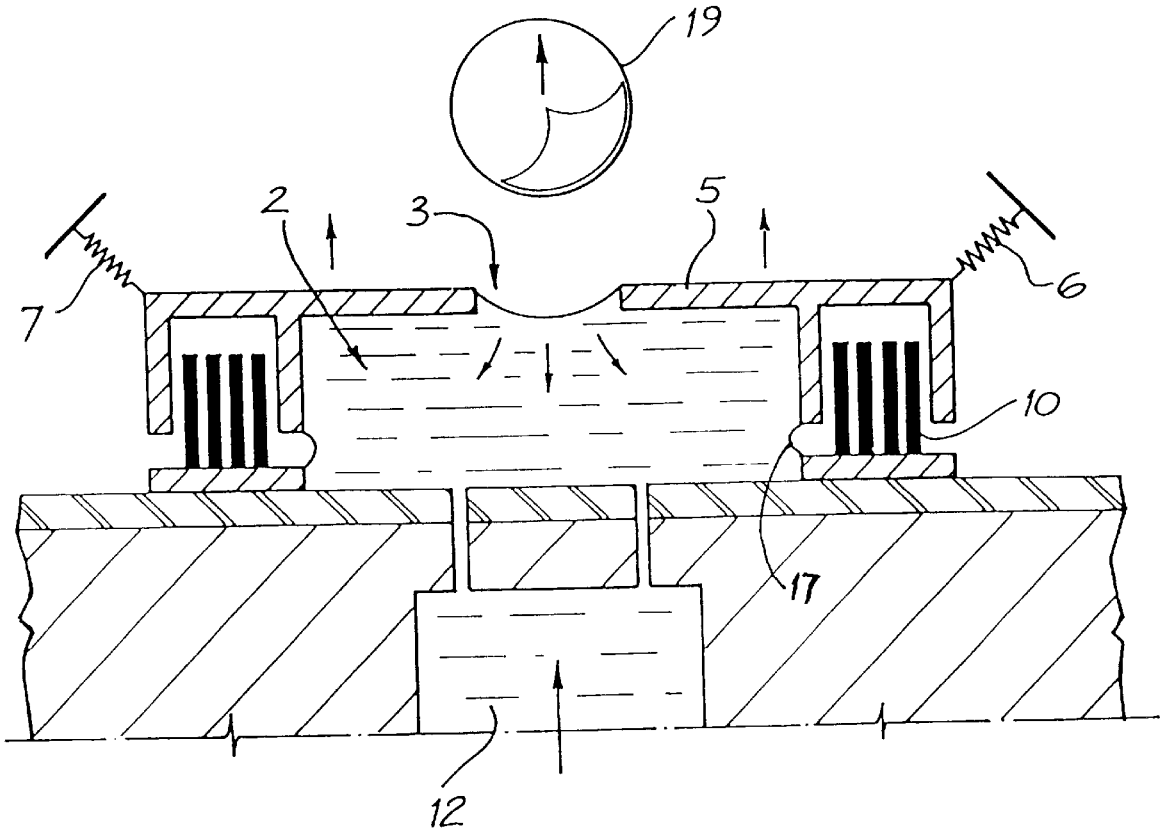

Turning now to FIG. 1 to FIG. 3, there will now be explained the operation of this embodiment.

Turning initially to FIG. 1, there is illustrated an ink jet nozzle arrangement 1 which includes a nozzle chamber 2 which connects with an ink ejection nozzle 3 such that, when in a quiescent position, an ink meniscus 4 forms over the nozzle 3. The nozzle 3 is formed in a magnetic nozzle plate 5 which can be constructed from a ferrous material. Attached to the nozzle plate 5 is a series of leaf springs e.g. 6, 7 which bias the nozzle plate 5 away from a base plate 9. Between the nozzle plate 5 and the base plate 9, there is provided a conductive coil 10 which is interconnected and controlled via a lower circuitry layer 11 which can comprise a standard CMOS circuitry layer. The ink chamber 2 is supplied with ink from a lower ink supply channel 12 which is formed by etching through a wafer substrate 13. The wafer substrate 13 can comprise a semiconductor wafer substrate. The ink chamber 2 is interconnected to the ink supply channel 12 by means of a series of slots 14 which can be etched through the CMOS layer 11.

The area around the coil 10 is hydrophobically treated so that, during operation, a small meniscus e.g. 16, 17 forms between the nozzle plate 5 and base plate 9.

When it is desired to eject a drop of ink, the coil 10 is energized. This results in a movement of the plate 5 as illustrated in FIG. 2. The general downward movement of the plate 5 results in a substantial increase in pressure within nozzle chamber 2. The increase in pressure results in a rapid growth in the meniscus 4 as ink flows out of the nozzle chamber 3. The movement of the plate 5 also results in the springs 6, 7 undergoing a general resilient extension. The small width of the slot 14 results in minimal outflows of ink into the nozzle chamber 12.

Moments later, as illustrated in FIG. 3, the coil 10 is deactivated resulting in a return of the plate 5 towards its quiescent position as a result of the springs 6, 7 acting on the nozzle plate 5. The return of the nozzle plate 5 to its quiescent position results in a rapid decrease in pressure within the nozzle chamber 2 which in turn results in a general back flow of ink around the ejection nozzle 3. The forward momentum of the ink outside the nozzle plate 3 and the back suction of the ink around the ejection nozzle 3 results in a drop 19 being formed and breaking off so as to continue to the print media.

The surface tension characteristics across the nozzle 3 result in a general inflow of ink from the ink supply channel 12 until such time as the quiescent position of FIG. 1 is again reached. In this manner, a coil actuated magnetic ink jet print head is formed for the adoption of ink drops on demand. Importantly, the area around the coil 10 is hydrophobically treated so as to expel any ink from flowing into this area.

Figure 4:
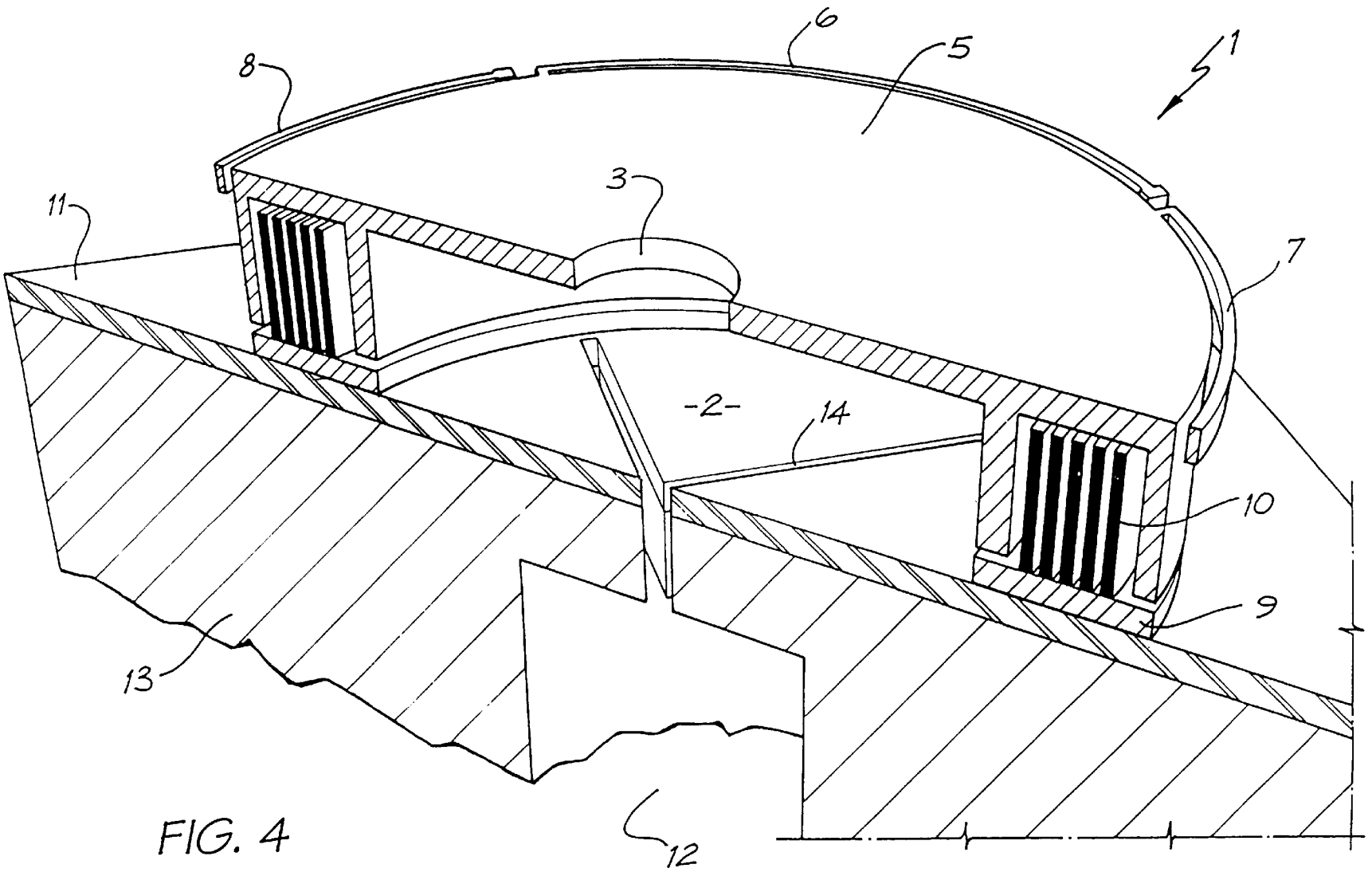
FIG. 4 illustrates a side perspective view, partly in section, of a single ink jet nozzle arrangement of an element.

Turning now to FIG. 4, there is illustrated a side perspective view, partly in section of a single nozzle arrangement constructed in accordance with the principles as previously outlined with respect to FIG. 1 to FIG. 3. The arrangement 1 includes a nozzle plate 5 which is formed around an ink supply chamber 2 and includes an ink ejection nozzle 3. A series of leaf spring elements 6–8 are also provided which can be formed from the same material as the nozzle plate 5. A base plate 9 also is provided for encompassing the coil 10. The wafer 13 includes a series of slots 14 for the wicking and flowing of ink into nozzle chamber 2 with the nozzle chamber 2 being interconnected via the slots with an ink supply channel 12. The slots 14 are of a thin elongated form so as to provide for fluidic resistance to a rapid outflow of fluid from the chamber 2.

The coil 10 is conductive interconnected at a predetermined portion (not shown) with a lower CMOS layer for the control and driving of the coil 10 and movement of base plate 5. Alternatively, the plate 9 can be broken into two separate semi-circular plates and the coil 10 can have separate ends connected through one of the semi circular plates through to a lower CMOS layer.

Obviously, an array of ink jet nozzle devices can be formed at a time on a single silicon wafer so as to form multiple printheads.

Figure 5:
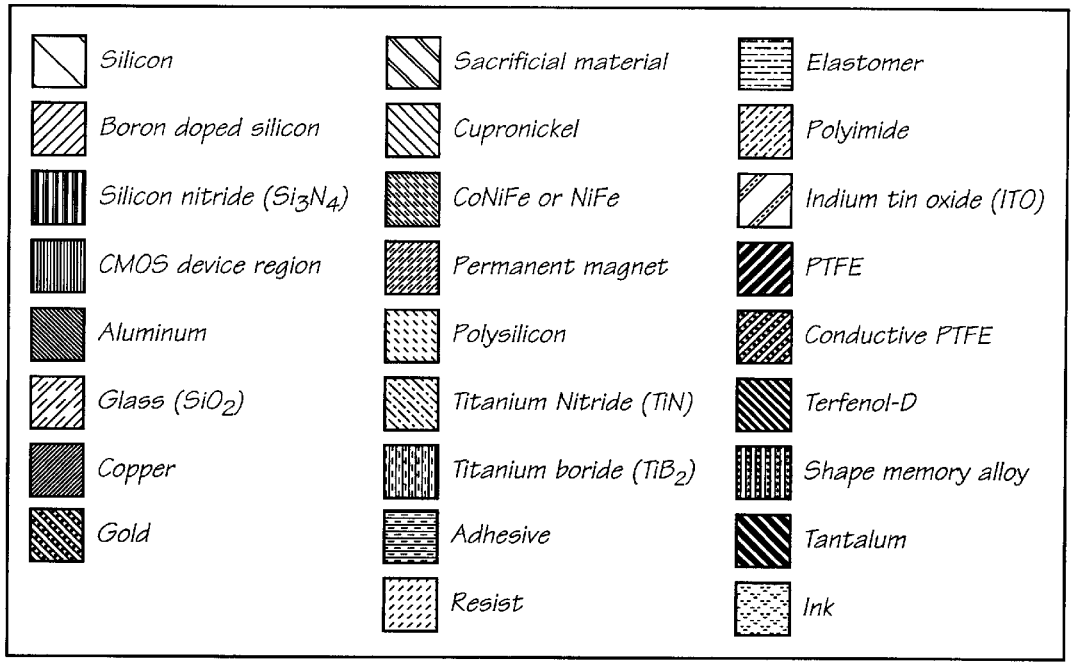
FIG. 5 provides a legend of the materials indicated in FIG. 6 to 21.
Figure 6:
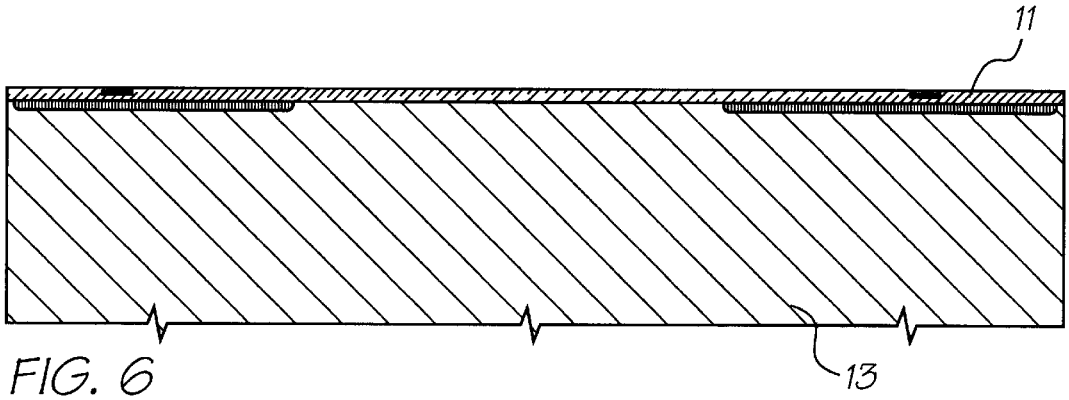
FIG. 6 to FIG. 21 illustrate sectional views of the manufacturing steps in one form of construction of an ink jet printhead nozzle.

One form of detailed manufacturing process which can be used to fabricate monolithic ink jet print heads operating in accordance with the principles taught by the present embodiment can proceed utilizing the following steps:

1. Using a double sided polished wafer 13, complete a 0.5 micron, one poly, 2 metal CMOS process 11. Due to high current densities, both metal layers should be copper for resistance to electromigration. This step is shown in FIG. 6. For clarity, these diagrams may not be to scale, and may not represent a cross section though any single plane of the nozzle. FIG. 5 is a key to representations of various materials in these manufacturing diagrams, and those of other cross referenced ink jet configurations.

Figure 7:
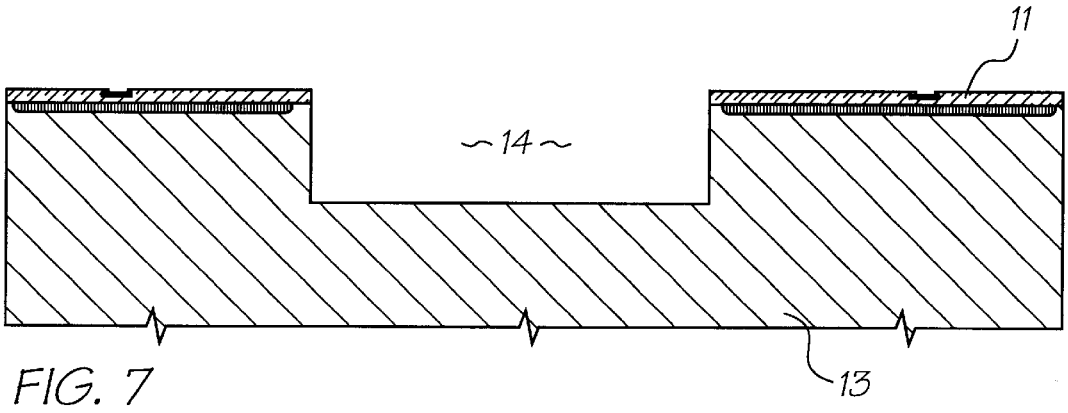
Figure 8:
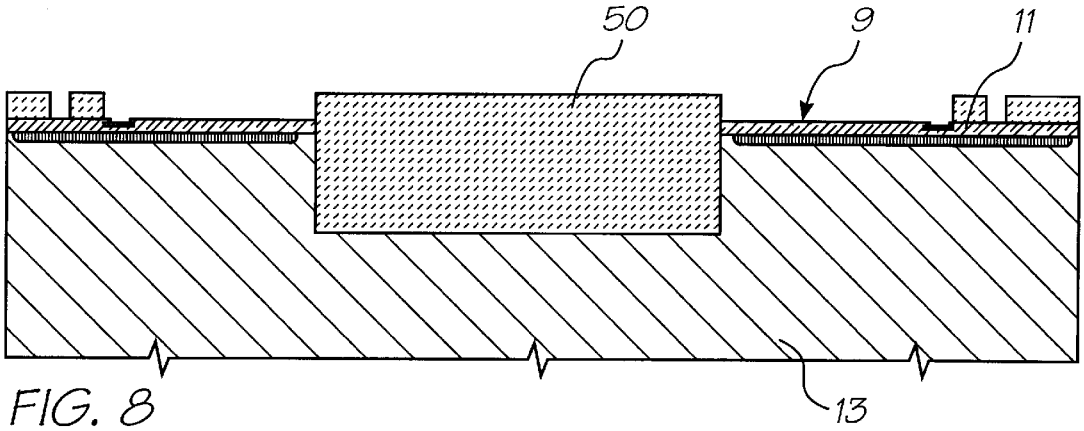
Figure 9:
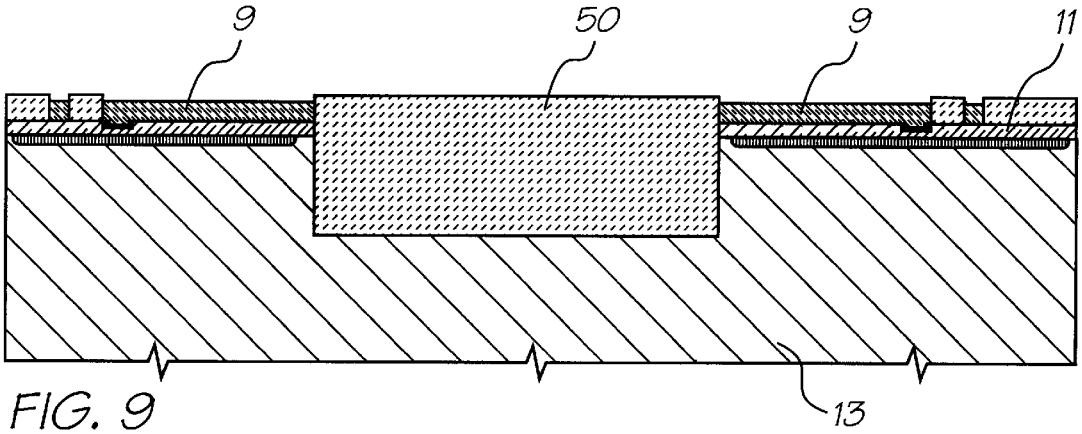
Figure 10:
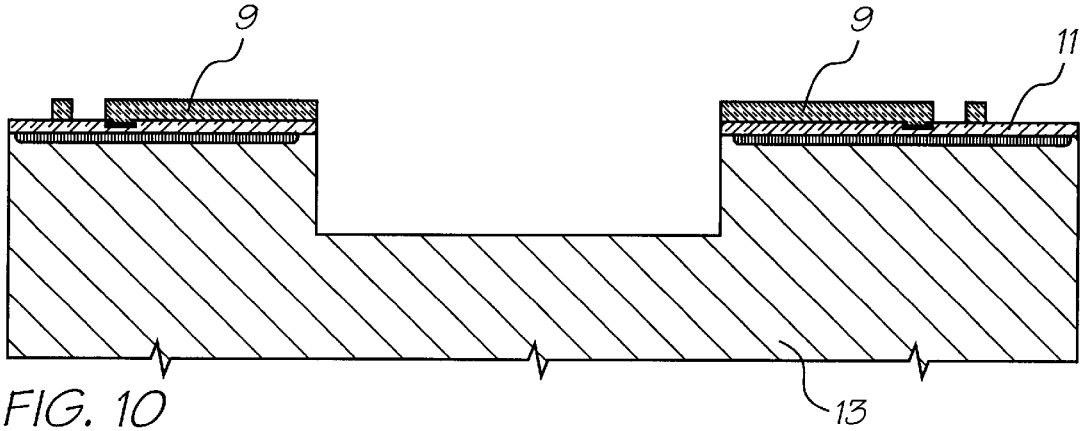
Figure 11:
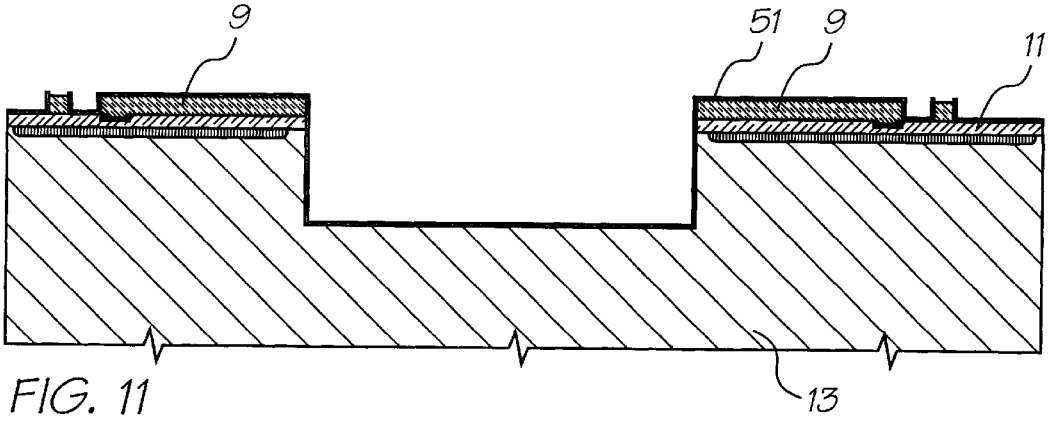
Figure 12:
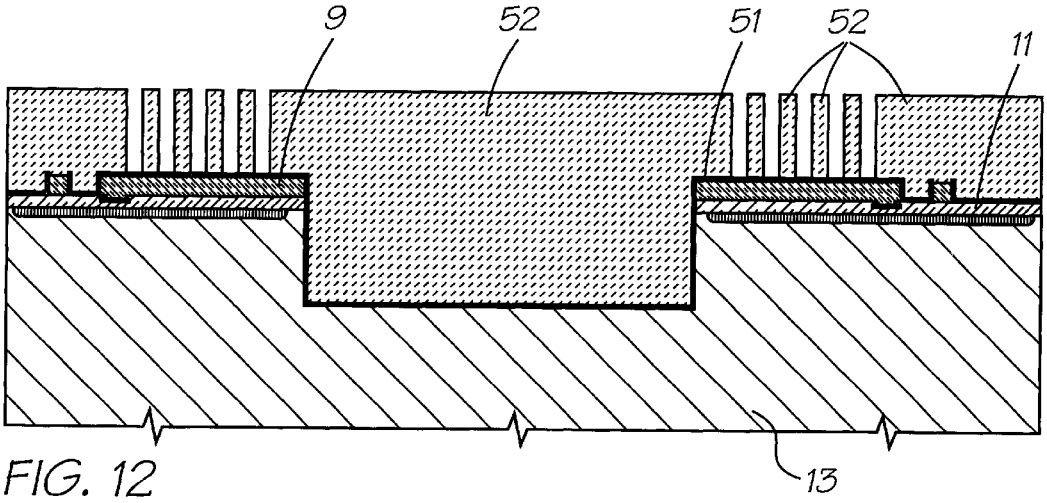
Figure 13:
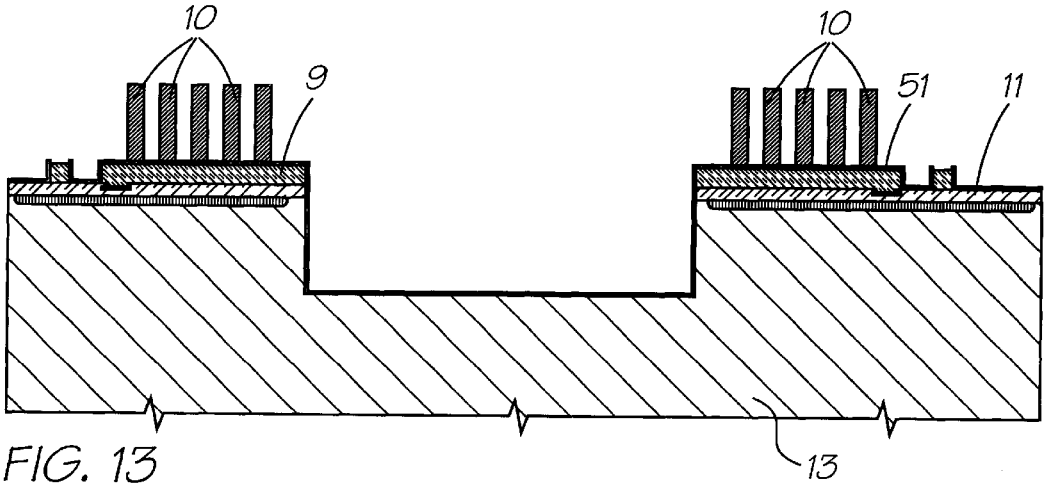
Figure 14:
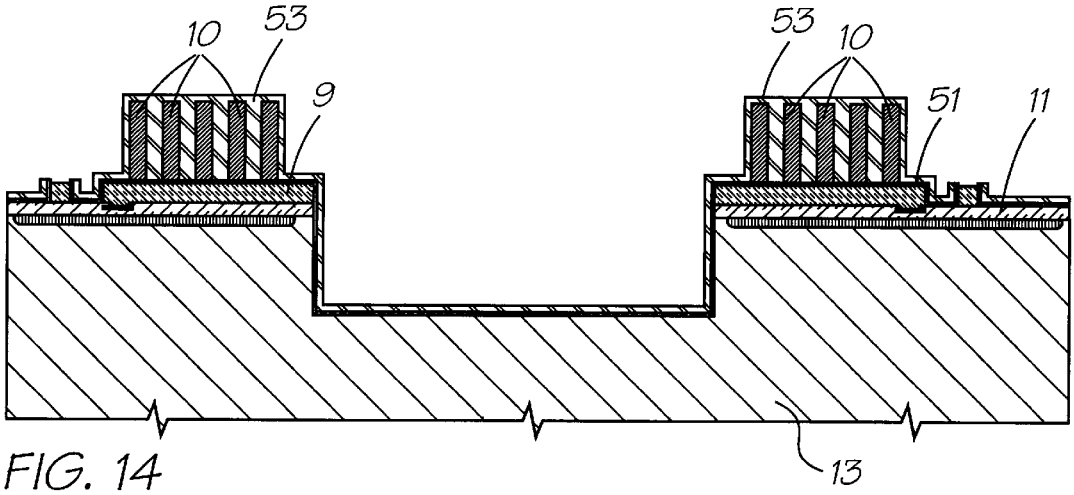
Figure 15:
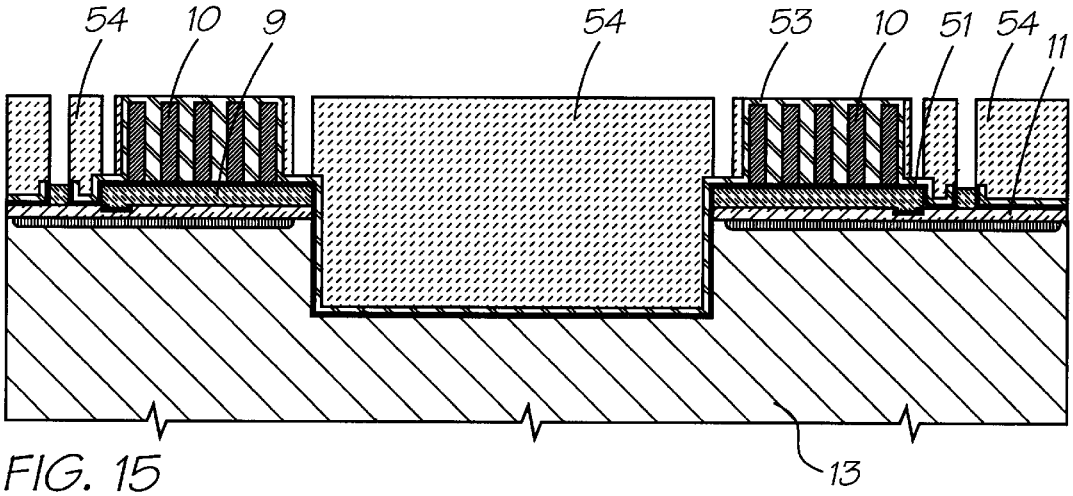
Figure 16:
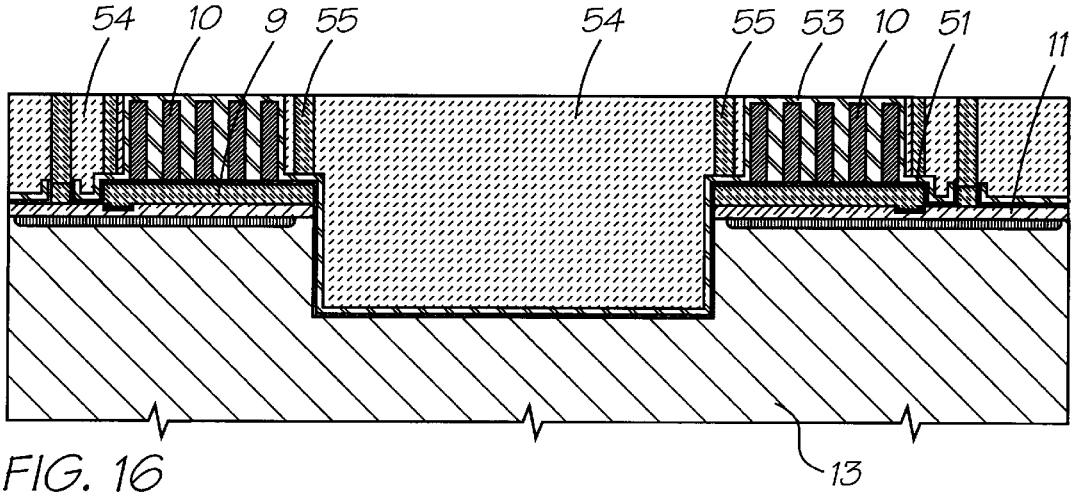
Figure 17:
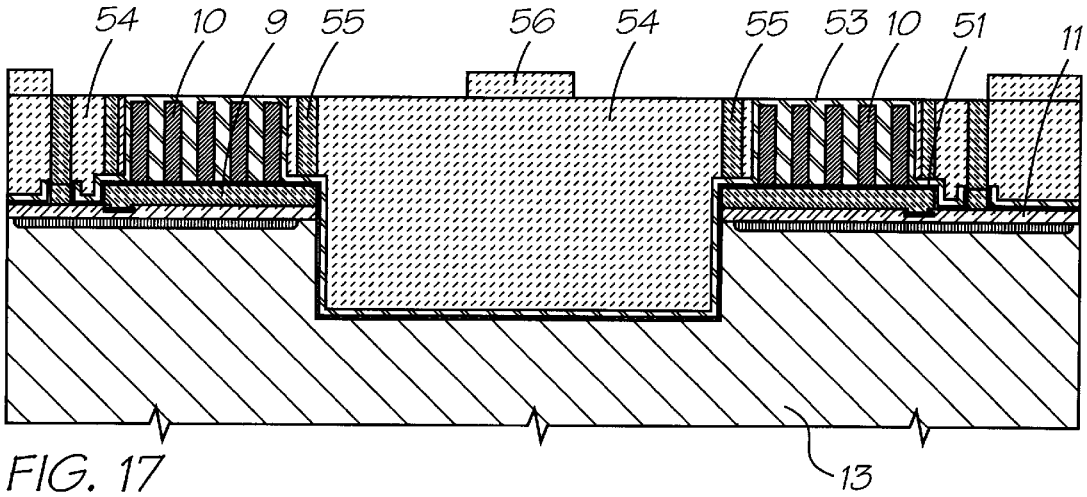
Figure 18:
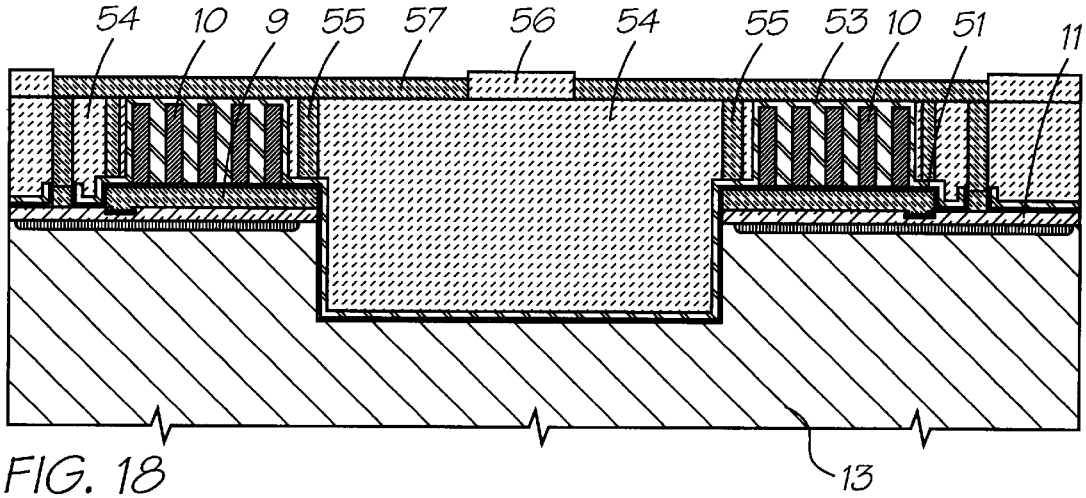
Figure 19:
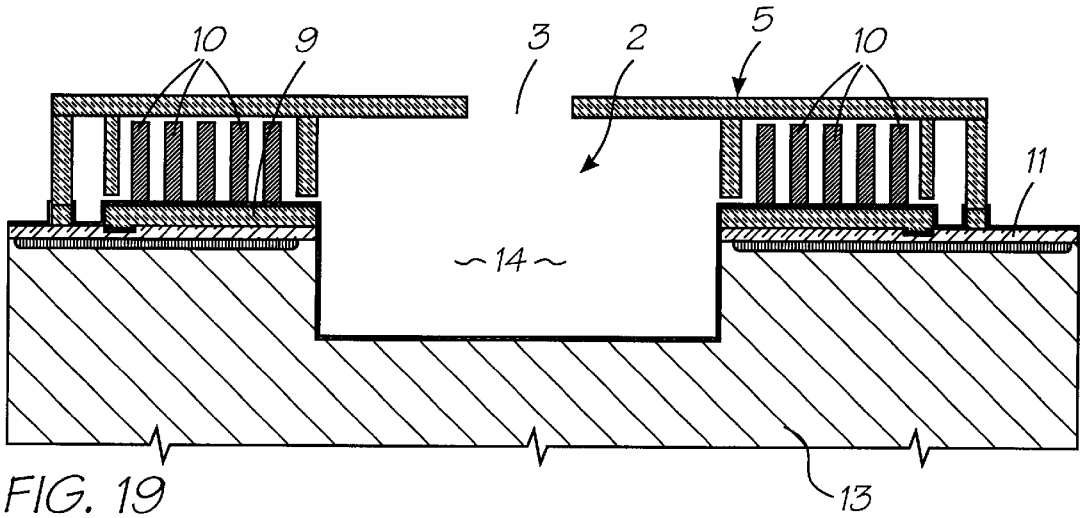
Figure 20:
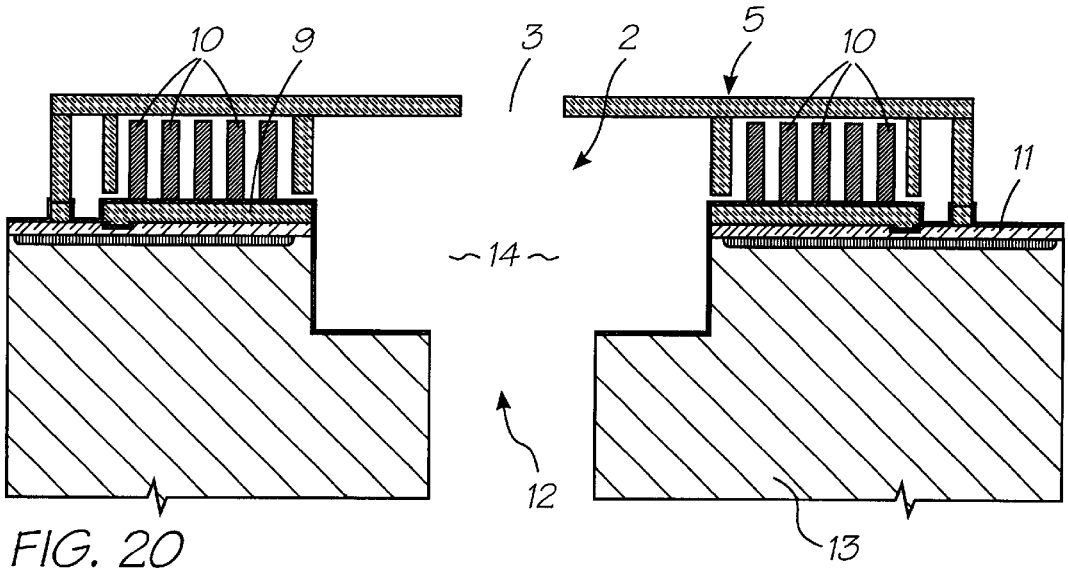
Figure 21:
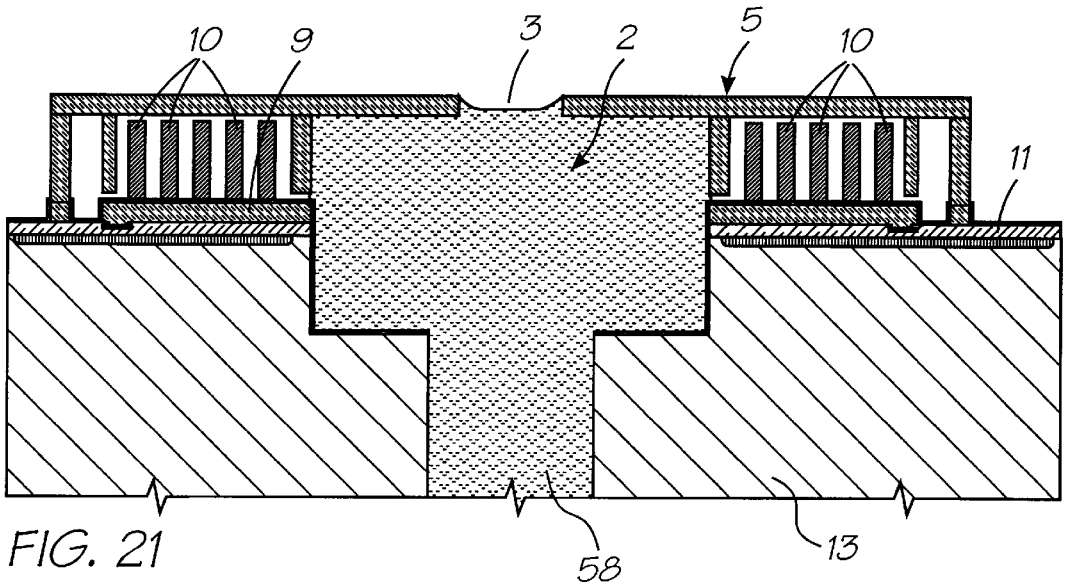

2. Etch the CMOS oxide layers down to silicon or aluminum using Mask 1. This mask defines the nozzle chamber inlet cross, the edges of the print heads chips, and the vias for the contacts from the second level metal electrodes to the two halves of the split fixed magnetic plate 9.
3. Plasma etch the silicon to a depth of 15 microns, using oxide from step 2 as a mask. This etch does not substantially etch the second level metal. This step is shown in FIG. 7.
4. Deposit a seed layer of cobalt nickel iron alloy. CoNiFe is chosen due to a high saturation flux density of 2 Tesla, and a low coercivity. [Osaka, Tetsuya et al, A soft magnetic CoNiFe film with high saturation magnetic flux density, Nature 392, 796–798 (1998)].
5. Spin on 4 microns of resist 50, expose with Mask 2, and develop. This mask defines the split fixed magnetic plate 9, for which the resist acts as an electroplating mold. This step is shown in FIG. 8.
6. Electroplate 3 microns of CoNiFe. This step is shown in FIG. 9.
7. Strip the resist and etch the exposed seed layer. This step is shown in FIG. 10.
8. Deposit 0.5 microns of silicon nitride 51, which insulates the solenoid from the fixed magnetic plate 9.
9. Etch the nitride layer using Mask 3. This mask defines the contact vias from each end of the solenoid coil to the two halves of the split fixed magnetic plate 9, as well as returning the nozzle chamber 2 to a hydrophilic state. This step is shown in FIG. 11.
10. Deposit an adhesion layer plus a copper seed layer. Copper is used for its low resistivity (which results in higher efficiency) and its high electromigration resistance, which increases reliability at high current densities.
11. Spin on 13 microns of resist and expose using Mask 4, which defines the solenoid spiral coil, for which the resist acts as an electroplating mold. As the resist is thick and the aspect ratio is high, an X-ray proximity process, such as LIGA, can be used. This step is shown in FIG. 12.
12. Electroplate 12 microns of copper.
13. Strip the resist and etch the exposed copper seed layer. This step is shown in FIG. 13.
14. Wafer probe. All electrical connections are complete at this point, bond pads are accessible, and the chips are not yet separated.
15. Deposit 0.1 microns of silicon nitride, which acts as a corrosion barrier (not shown).
16. Deposit 0.1 microns of PIFE (not shown), which makes the top surface of the fixed magnetic plate 9 and the solenoid hydrophobic, thereby preventing the space between the solenoid and the magnetic piston from filling with ink (if a water based ink is used. In general, these surfaces should be made ink-phobic).
17. Etch the PTFE layer using Mask 5. This mask defines the hydrophilic region of the nozzle chamber 2. The etch returns the nozzle chamber 2 to a hydrophilic state.
18. Deposit 1 micron of sacrificial material 53. This defines the magnetic gap, and the travel of the magnetic piston.
19. Etch the sacrificial layer using Mask 6. This mask defines the spring posts. This step is shown in FIG. 14.
20. Deposit a seed layer of CoNiFe.
21. Deposit 12 microns of resist 54. As the solenoids will prevent even flow during a spin-on application, the resist should be sprayed on. Expose the resist using Mask 7, which defines the walls of the magnetic plunger, plus the spring posts. As the resist is thick and the aspect ratio is high, an X-ray proximity process, such as LIGA, can be used. This step is shown in FIG. 15.
22. Electroplate 12 microns of CoNiFe. This step is shown in FIG. 16.
23. Deposit a seed layer of CoNiFe.
24. Spin on 4 microns of resist 56, expose with Mask 8, and develop. This mask defines the roof of the magnetic plunger, the nozzle, the springs, and the spring posts. The resist forms an electroplating mold for these parts. This step is shown in FIG. 17.
25. Electroplate 3 microns of CoNiFe 57. This step is shown in FIG. 18.
26. Strip the resist, sacrificial, and exposed seed layers. This step is shown in FIG. 19.
27. Back-etch through the silicon wafer until the nozzle chamber inlet cross is reached using Mask 9. This etch may be performed using an ASE Advanced Silicon Etcher from Surface Technology Systems. The mask defines the ink inlets 12 which are etched through the wafer. The wafer is also diced by this etch. This step is shown in FIG. 20.
28. Mount the printheads in their packaging, which may be a molded plastic former incorporating ink channels which supply the appropriate color ink to the ink inlets at the back of the wafer.
29. Connect the printheads to their interconnect systems. For a low profile connection with minimum disruption of airflow, TAB may be used. Wire bonding may also be used if the printer is to be operated with sufficient clearance to the paper.
30. Fill the completed printheads with ink 58 and test them. A filled nozzle is shown in FIG. 21.

Figure 22:
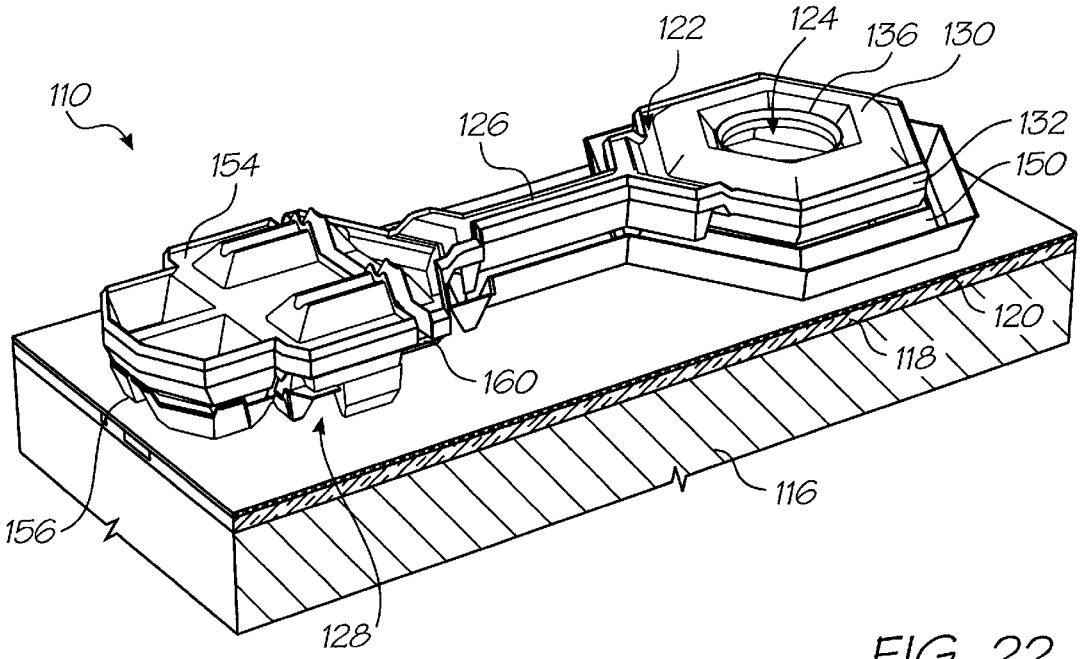
FIG. 22 shows a three dimensional, schematic view of a nozzle assembly for an ink jet printhead in accordance with another embodiment of the invention.

Referring now to FIG. 22 of the drawings, a nozzle assembly, in accordance with a further embodiment of the invention is designated generally by the reference numeral 110. An ink jet printhead has a plurality of nozzle assemblies 110 arranged in an array 114 (FIGS. 26 and 27) on a silicon substrate 116. The array 114 will be described in greater detail below.

The assembly 110 includes a silicon substrate or wafer 116 on which a dielectric layer 118 is deposited. A CMOS passivation layer 120 is deposited on the dielectric layer 118.

Each nozzle assembly 110 includes a nozzle 122 defining a nozzle opening 124, a connecting member in the form of a lever arm 126 and an actuator 128. The lever arm 126 connects the actuator 128 to the nozzle 122.

Figure 23:
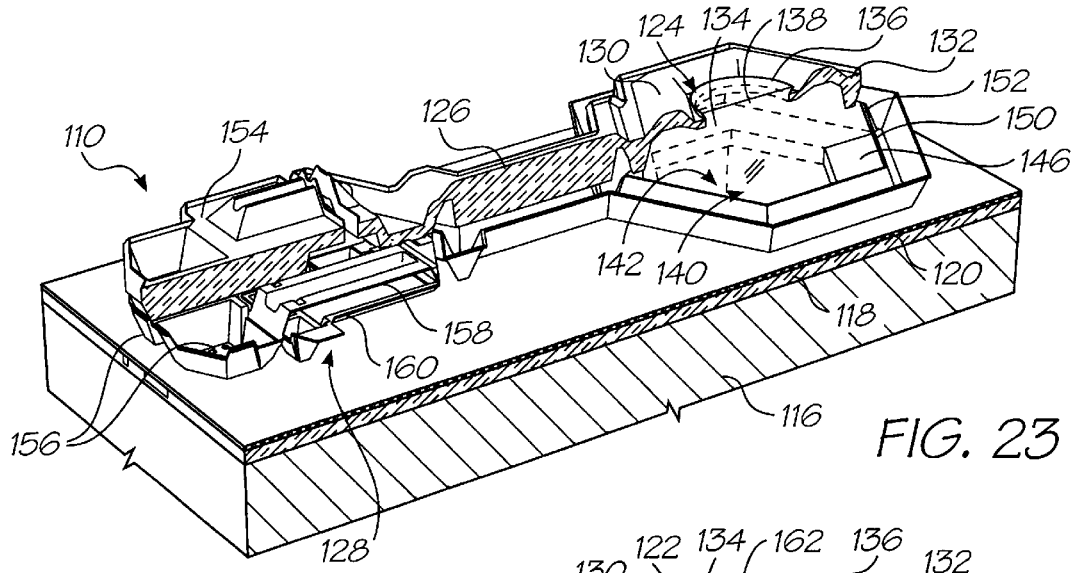
FIGS. 23 to 25 show a three dimensional, schematic illustration of an operation of the nozzle assembly of FIG. 22.
Figure 24:
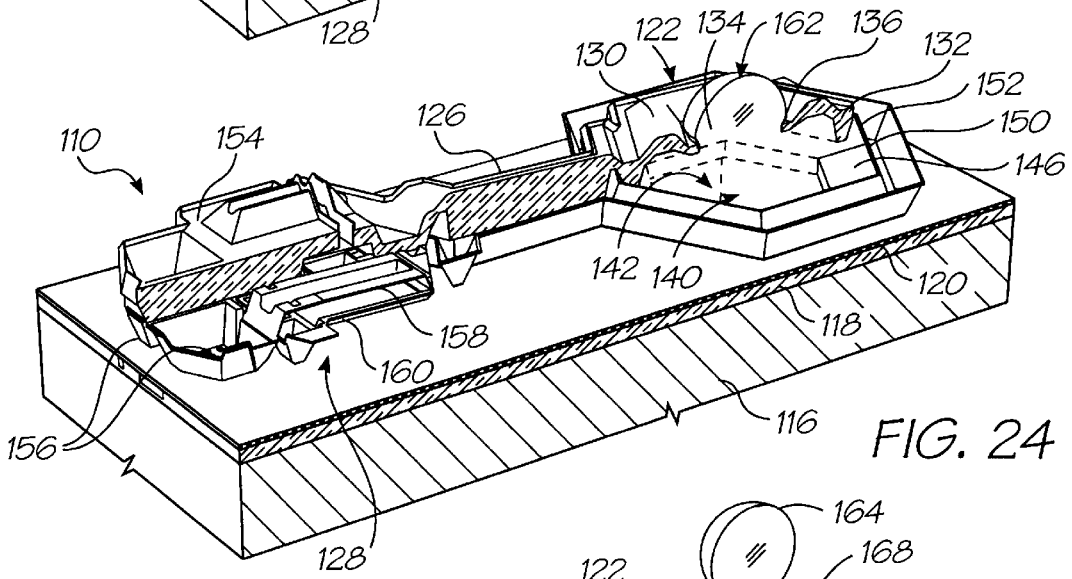
Figure 25:
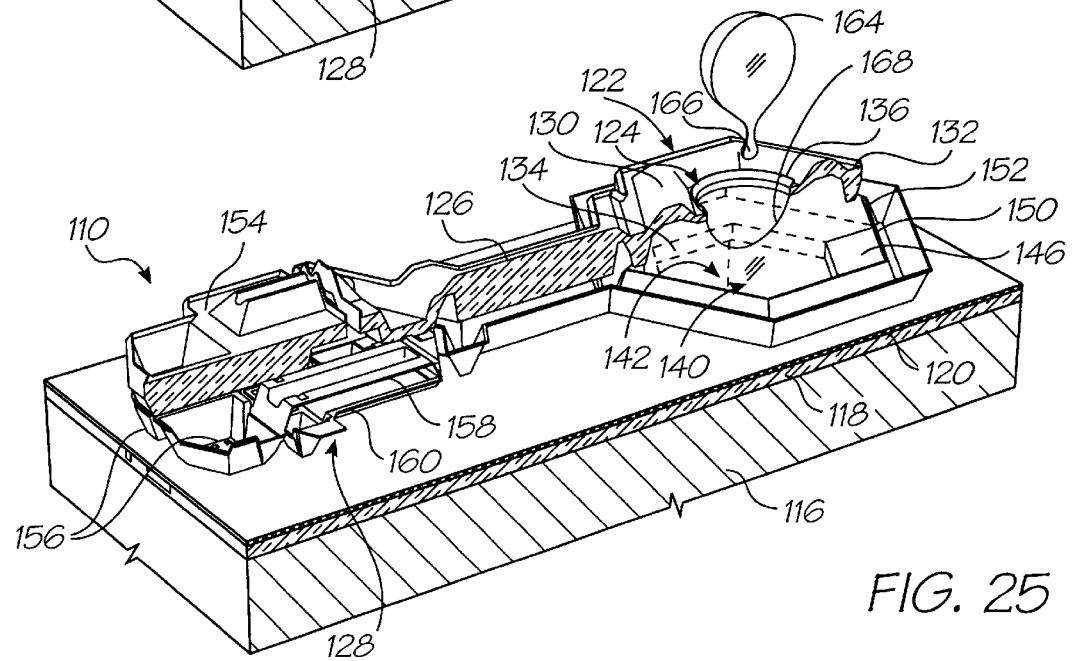

As shown in greater detail in FIGS. 23 to 25 of the drawings, the nozzle 122 comprises a crown portion 130 with a skirt portion 132 depending from the crown portion 130. The skirt portion 132 forms part of a peripheral wall of a nozzle chamber 134 (FIGS. 23 to 25 of the drawings). The nozzle opening 124 is in fluid communication with the nozzle chamber 134. It is to be noted that the nozzle opening 124 is surrounded by a raised rim 136 which "pins" a meniscus 138 (FIG. 23) of a body of ink 140 in the nozzle chamber 134.

An ink inlet aperture 142 (shown most clearly in FIG. 27) is defined in a floor 146 of the nozzle chamber 134. The aperture 142 is in fluid communication with an ink inlet channel 148 defined through the substrate 116.

A wall portion 150 bounds the aperture 142 and extends upwardly from the floor portion 146. The skirt portion 132, as indicated above, of the nozzle 122 defines a first part of a peripheral wall of the nozzle chamber 134 and the wall portion 150 defines a second part of the peripheral wall of the nozzle chamber 134.

The wall 150 has an inwardly directed lip 152 at its free end which serves as a fluidic seal which inhibits the escape of ink when the nozzle 122 is displaced, as will be described in greater detail below. It will be appreciated that, due to the viscosity of the ink 140 and the small dimensions of the spacing between the lip 152 and the skirt portion 132, the inwardly directed lip 152 and surface tension function as a seal for inhibiting the escape of ink from the nozzle chamber 134.

The actuator 128 is a thermal bend actuator and is connected to an anchor 154 extending upwardly from the substrate 116 or, more particularly, from the CMOS passivation layer 120. The anchor 154 is mounted on conductive pads 156 which form an electrical connection with the actuator 128.

The actuator 128 comprises a first, active beam 158 arranged above a second, passive beam 160. In a preferred embodiment, both beams 158 and 160 are of, or include, a conductive ceramic material such as titanium nitride (TiN).

Both beams 158 and 160 have their first ends anchored to the anchor 154 and their opposed ends connected to the arm 126. When a current is caused to flow through the active beam 158 thermal expansion of the beam 158 results. As the passive beam 160, through which there is no current flow, does not expand at the same rate, a bending moment is created causing the arm 126 and, hence, the nozzle 122 to be displaced downwardly towards the substrate 116 as shown in FIG. 24 of the drawings. This causes an ejection of ink through the nozzle opening 124 as shown at 162 in FIG. 24 of the drawings. When the source of heat is removed from the active beam 158, i.e. by stopping current flow, the nozzle 122 returns to its quiescent position as shown in FIG. 25 of the drawings. When the nozzle 122 returns to its quiescent position, an ink droplet 164 is formed as a result of the breaking of an ink droplet neck as illustrated at 166 in FIG. 25 of the drawings. The ink droplet 164 then travels on to the print media such as a sheet of paper. As a result of the formation of the ink droplet 164, a "negative" meniscus is formed as shown at 168 in FIG. 25 of the drawings. This "negative" meniscus 168 results in an inflow of ink 140 into the nozzle chamber 134 such that a new meniscus 138 (FIG. 23) is formed in readiness for the next ink drop ejection from the nozzle assembly 110.

Figure 26:
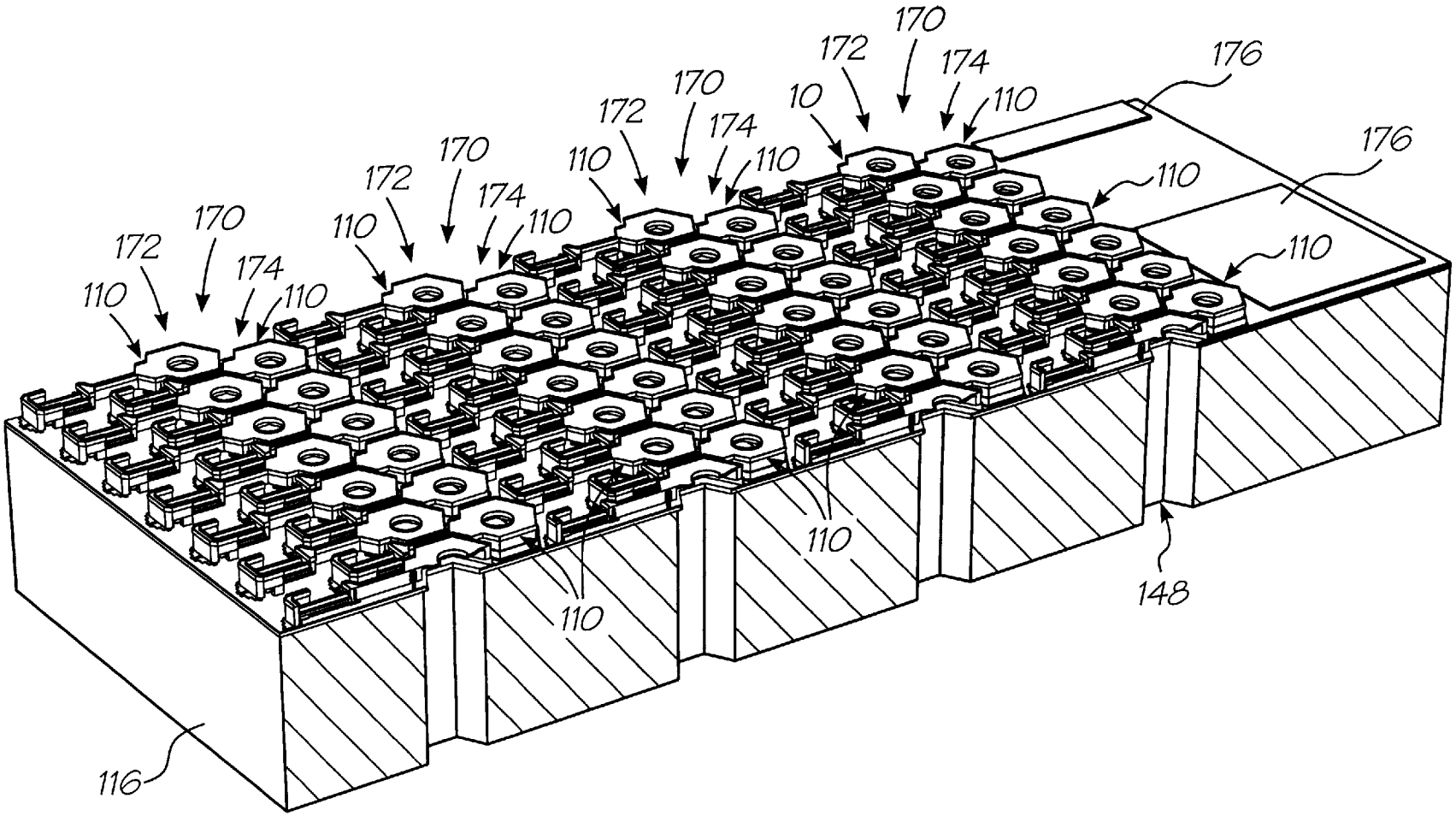
FIG. 26 shows a three dimensional view of a nozzle array constituting an ink jet printhead.
Figure 27:
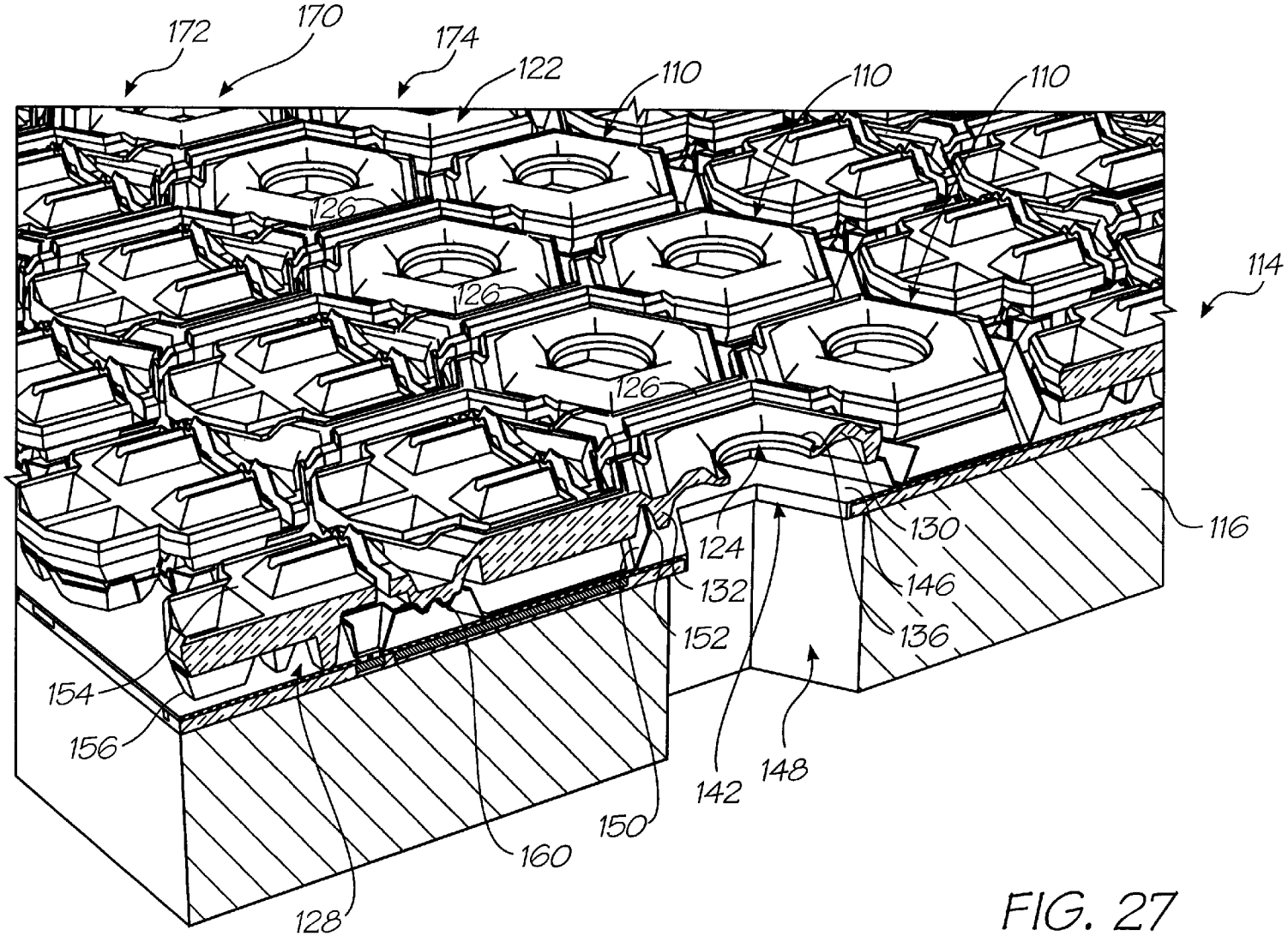
FIG. 27 shows, on an enlarged scale, part of the array of FIG. 26.

Referring now to FIGS. 26 and 27 of the drawings, the nozzle array 114 is described in greater detail. The array 114 is for a four color printhead. Accordingly, the array 114 includes four groups 170 of nozzle assemblies, one for each color. Each group 170 has its nozzle assemblies 110 arranged in two rows 172 and 174. One of the groups 170 is shown in greater detail in FIG. 27 of the drawings.

To facilitate close packing of the nozzle assemblies 110 in the rows 172 and 174, the nozzle assemblies 110 in the row 174 are offset or staggered with respect to the nozzle assemblies 110 in the row 172. Also, the nozzle assemblies 110 in the row 172 are spaced apart sufficiently far from each other to enable the lever arms 126 of the nozzle assemblies 110 in the row 174 to pass between adjacent nozzles 122 of the assemblies 110 in the row 172. It is to be noted that each nozzle assembly 110 is substantially dumbbell shaped so that the nozzles 122 in the row 172 nest between the nozzles 122 and the actuators 128 of adjacent nozzle assemblies 110 in the row 174.

Further, to facilitate close packing of the nozzles 122 in the rows 172 and 174, each nozzle 122 is substantially hexagonally shaped.

It will be appreciated by those skilled in the art that, when the nozzles 122 are displaced towards the substrate 116, in use, due to the nozzle opening 124 being at a slight angle with respect to the nozzle chamber 134 ink is ejected slightly off the perpendicular. It is an advantage of the arrangement shown in FIGS. 26 and 27 of the drawings that the actuators 128 of the nozzle assemblies 110 in the rows 172 and 174 extend in the same direction to one side of the rows 172 and 174. Hence, the ink droplets ejected from the nozzles 122 in the row 172 and the ink droplets ejected from the nozzles 122 in the row 174 are parallel to one another resulting in an improved print quality.

Also, as shown in FIG. 26 of the drawings, the substrate 116 has bond pads 176 arranged thereon which provide the electrical connections, via the pads 156, to the actuators 128 of the nozzle assemblies 110. These electrical connections are formed via the CMOS layer (not shown).

Figure 28:
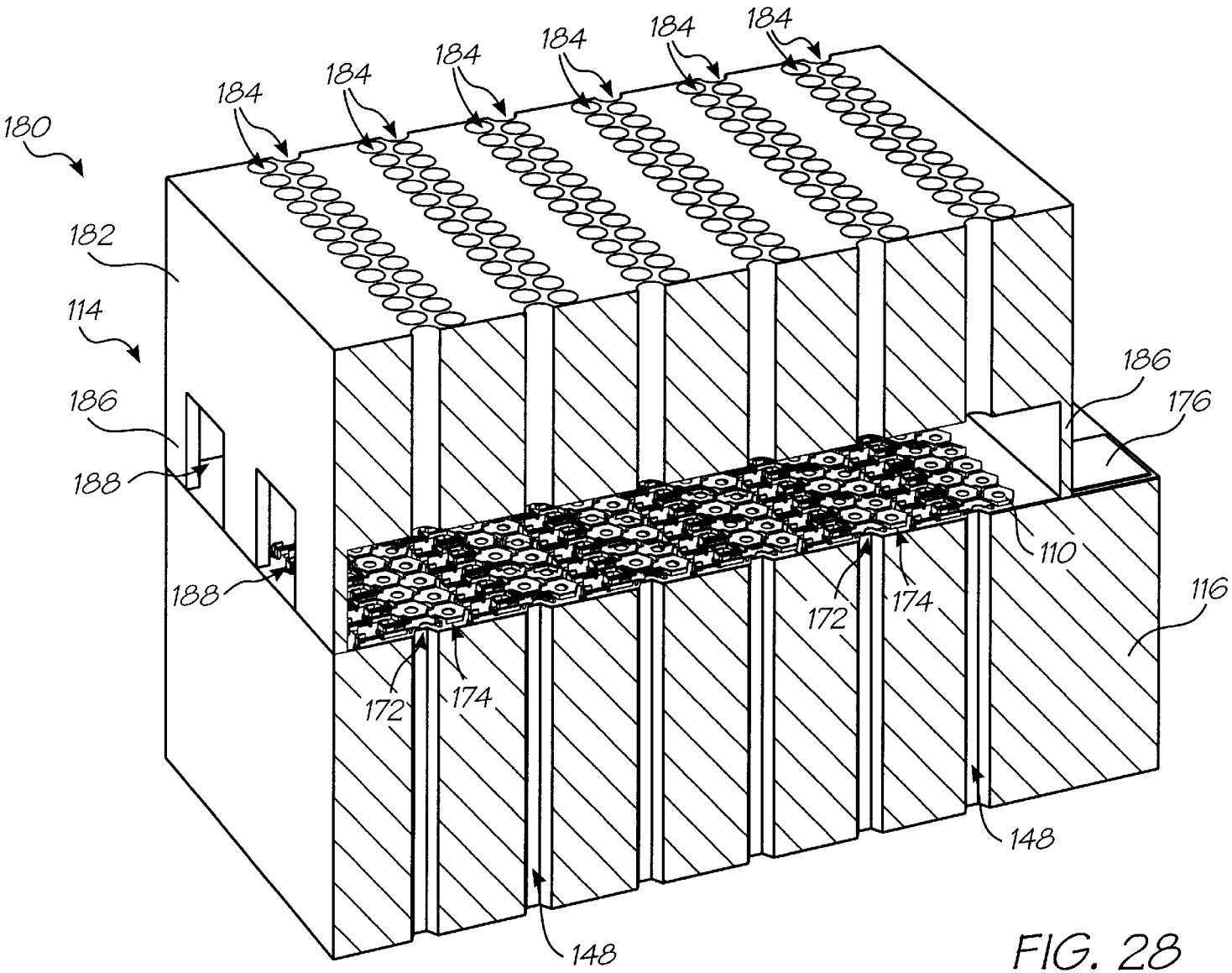
FIG. 28 shows a three dimensional view of an ink jet printhead including a nozzle guard.
Figure 30A:
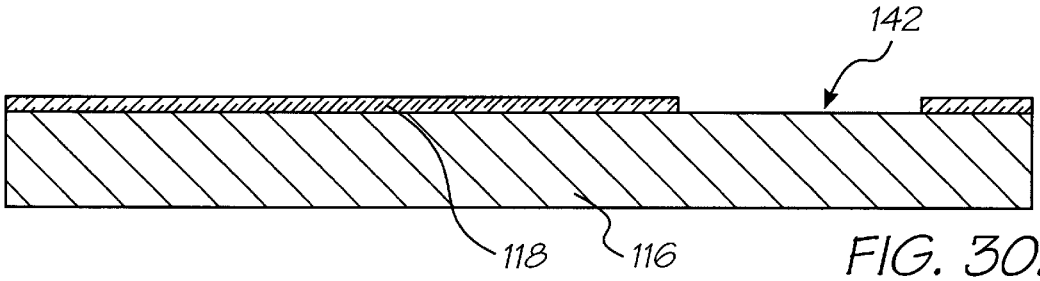
FIGS. 30*a* to 30*r* show sectional side views of the manufacturing steps.
Figure 31A:
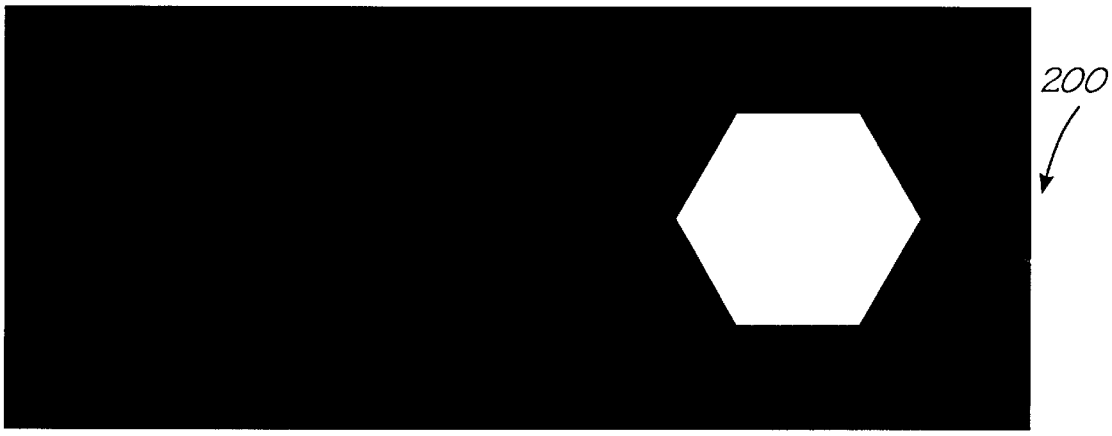
FIGS. 31*a* to 31*k* how layouts of masks used in various steps in the manufacturing process.

Referring to FIG. 28 of the drawings, a development of the invention is shown. With reference to the previous drawings, like reference numerals refer to like parts, unless otherwise specified.

In this development, a nozzle guard 180 is mounted on the substrate 116 of the array 114. The nozzle guard 180 includes a body member 182 having a plurality of passages 184 defined therethrough. The passages 184 are in register with the nozzle openings 124 of the nozzle assemblies 110 of the array 114 such that, when ink is ejected from any one of the nozzle openings 124, the ink passes through the associated passage 184 before striking the print media.

The body member 182 is mounted in spaced relationship relative to the nozzle assemblies 110 by limbs or struts 186. One of the struts 186 has air inlet openings 188 defined therein.

In use, when the array 114 is in operation, air is charged through the inlet openings 188 to be forced through the passages 184 together with ink travelling through the passages 184.

The ink is not entrained in the air as the air is charged through the passages 184 at a different velocity from that of the ink droplets 164. For example, the ink droplets 164 are ejected from the nozzles 122 at a velocity of approximately 3 m/s. The air is charged through the passages 184 at a velocity of approximately 1 m/s.

The purpose of the air is to maintain the passages 184 clear of foreign particles. A danger exists that these foreign particles, such as dust particles, could fall onto the nozzle assemblies 110 adversely affecting their operation. With the provision of the air inlet openings 88 in the nozzle guard 180 this problem is, to a large extent, obviated.

Referring now to FIGS. 29 to 31 of the drawings, a process for manufacturing the nozzle assemblies 110 is described.

Starting with the silicon substrate or wafer 116, the dielectric layer 118 is deposited on a surface of the wafer 116. The dielectric layer 118 is in the form of approximately 1.5 microns of CVD oxide. Resist is spun on to the layer 118 and the layer 118 is exposed to mask 200 and is subsequently developed.

After being developed, the layer 118 is plasma etched down to the silicon layer 116. The resist is then stripped and the layer 118 is cleaned. This step defines the ink inlet aperture 142.

Figure 29A:
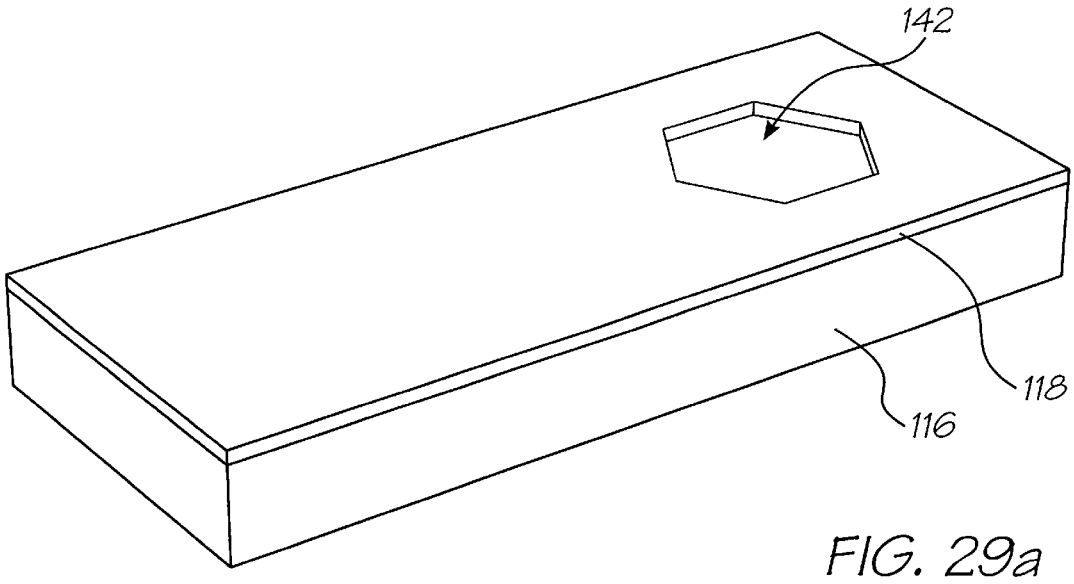
FIGS. 29*a* to 29*r* show three-dimensional views of steps in the manufacture of a nozzle assembly of an ink jet printhead.
Figure 29B:
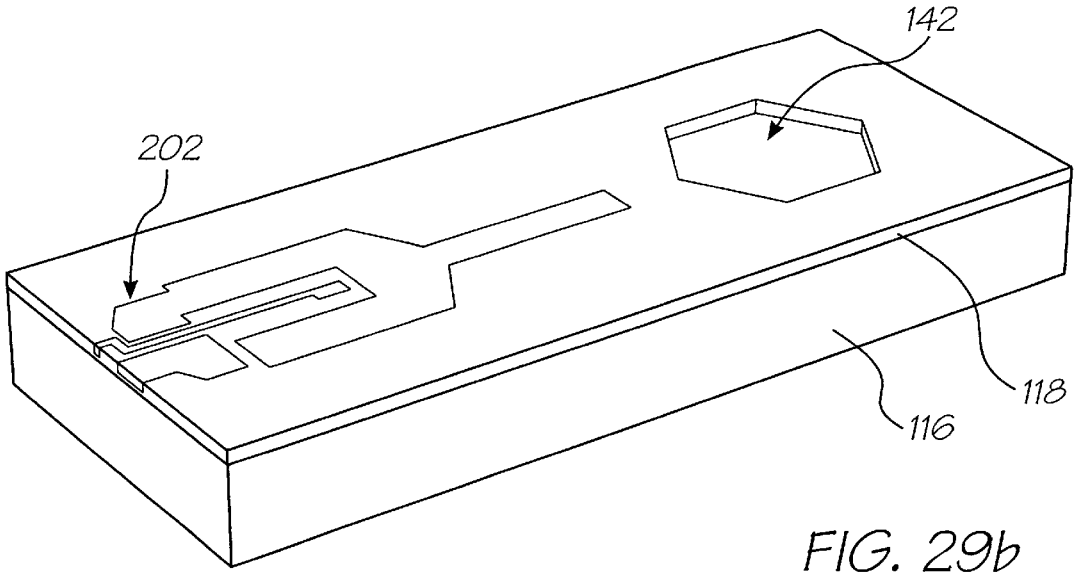
Figure 30B:
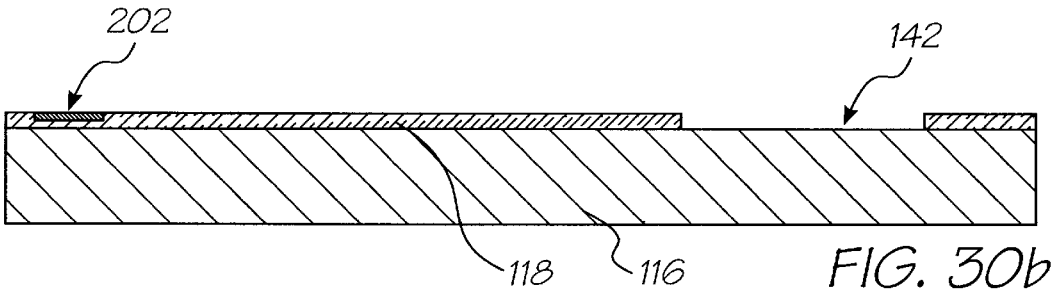
Figure 31B:
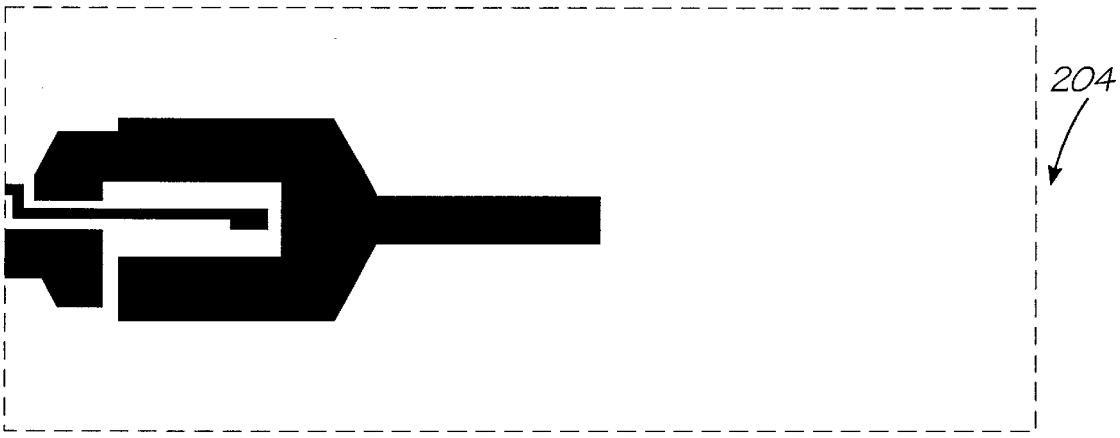
Figure 29C:
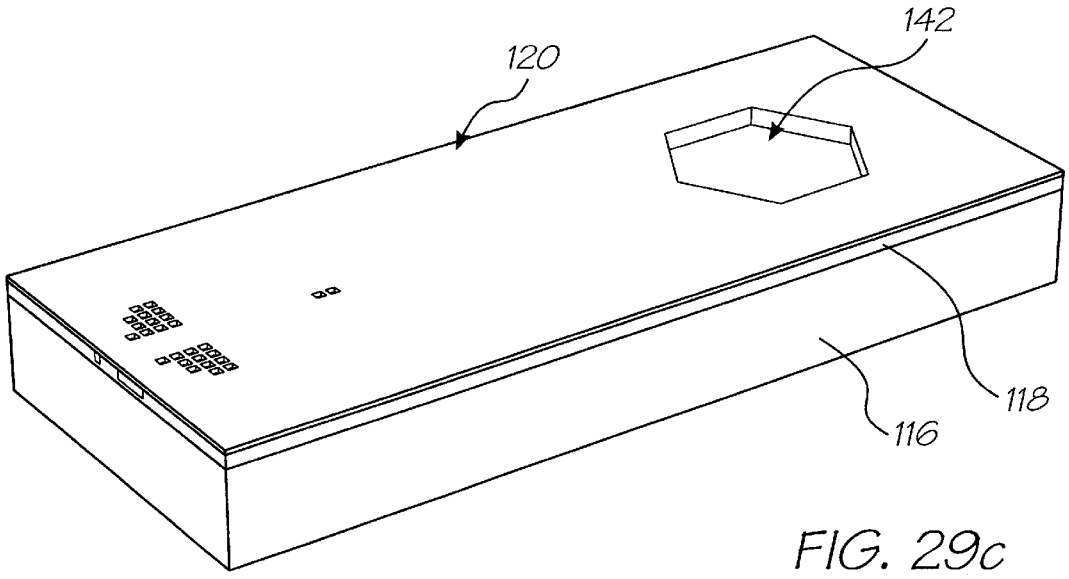
Figure 30C:
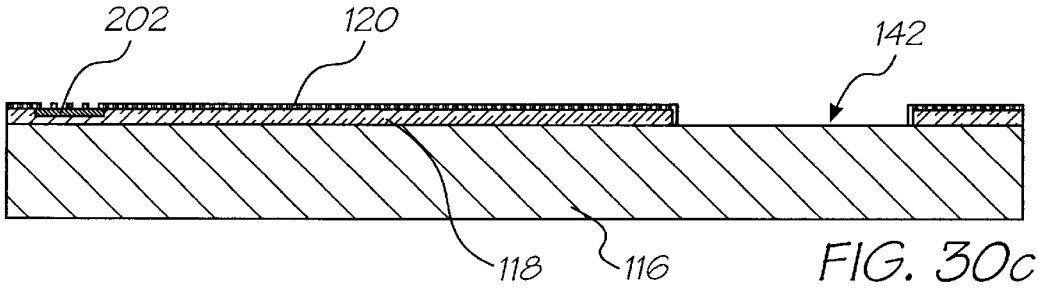
Figure 31C:
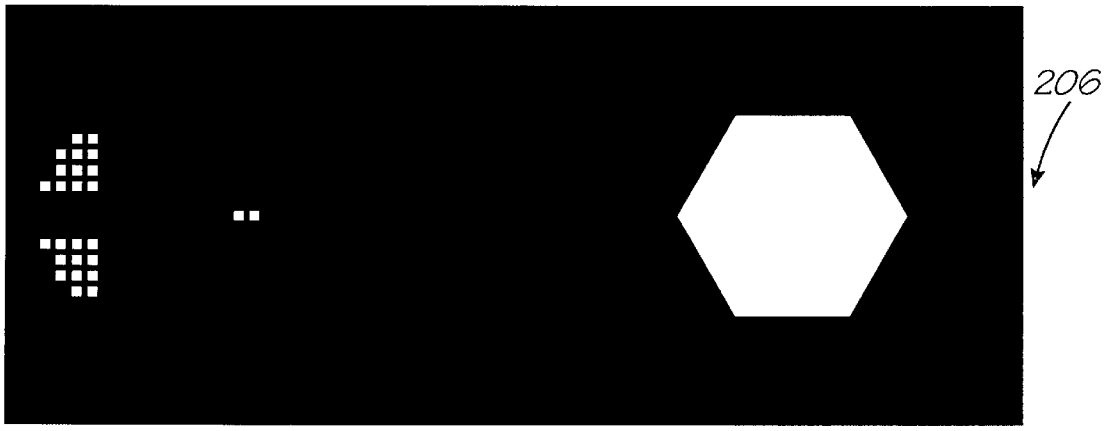
Figure 29D:
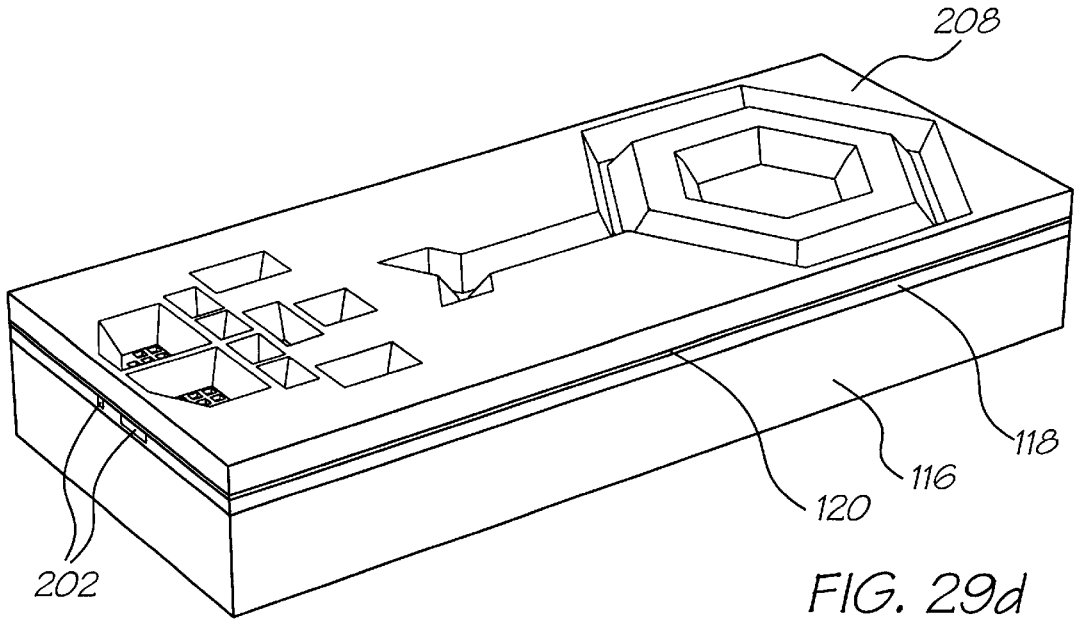
Figure 30D:
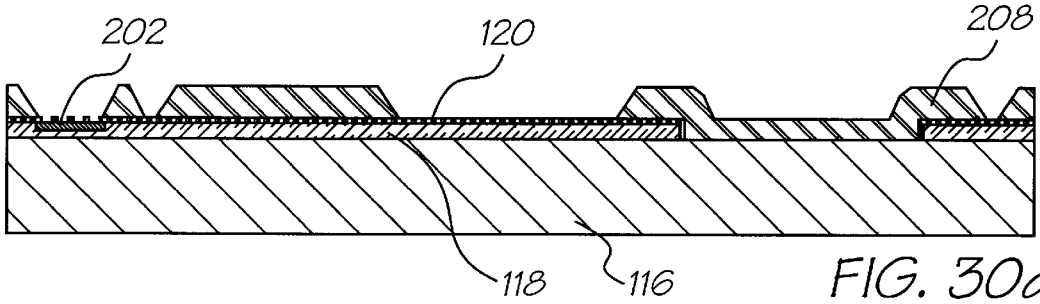
Figure 31D:
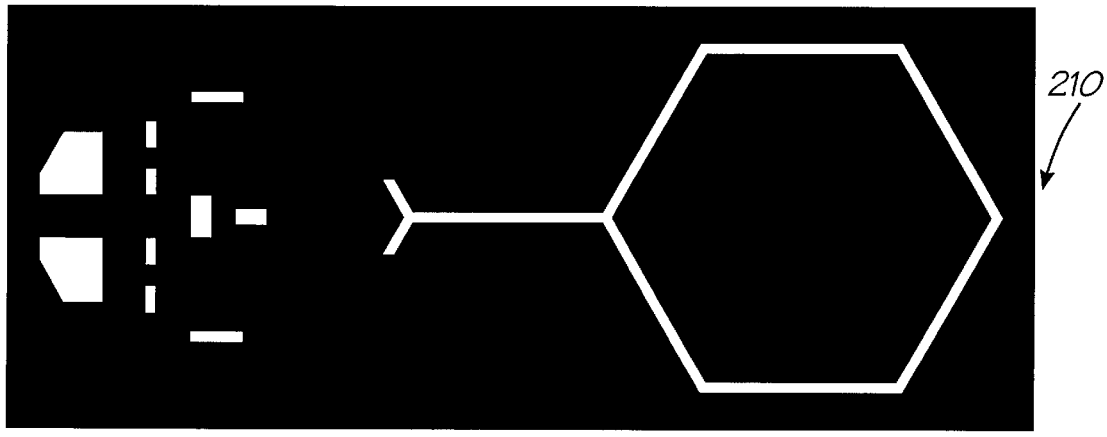

In FIG. 29*b* of the drawings, approximately 0.8 microns of aluminum 202 is deposited on the layer 118. Resist is spun on and the aluminum 202 is exposed to mask 204 and developed. The aluminum 202 is plasma etched down to the oxide layer 118, the resist is stripped and the device is cleaned. This step provides the bond pads and interconnects to the ink jet actuator 128. This interconnect is to an NMOS drive transistor and a power plane with connections made in the CMOS layer (not shown).

Approximately 0.5 microns of PECVD nitride is deposited as the CMOS passivation layer 120. Resist is spun on and the layer 120 is exposed to mask 206 whereafter it is developed. After development, the nitride is plasma etched down to the aluminum layer 202 and the silicon layer 116 in the region of the inlet aperture 142. The resist is stripped and the device cleaned.

A layer 208 of a sacrificial material is spun on to the layer 120. The layer 208 is 6 microns of photo-sensitive polyimide or approximately 4 $\mu$m of high temperature resist. The layer 208 is softbaked and is then exposed to mask 210 whereafter it is developed. The layer 208 is then hardbaked at 400° C. for one hour where the layer 208 is comprised of polyimide or at greater than 300° C. where the layer 208 is high temperature resist. It is to be noted in the drawings that the pattern-dependent distortion of the polyimide layer 208 caused by shrinkage is taken into account in the design of the mask 210.

Figure 29E:
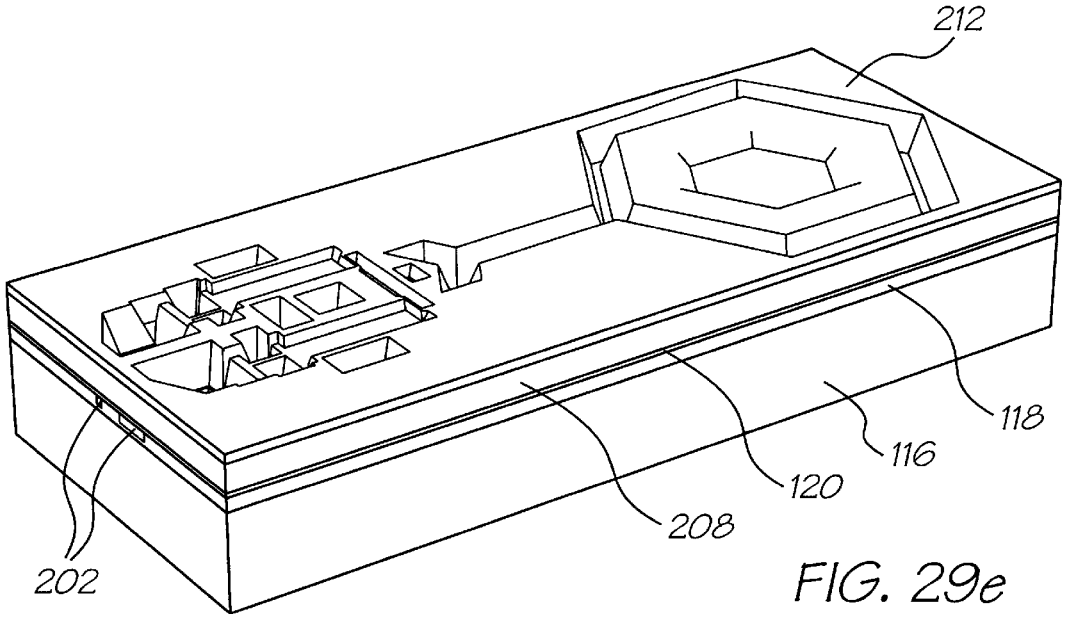
Figure 30E:
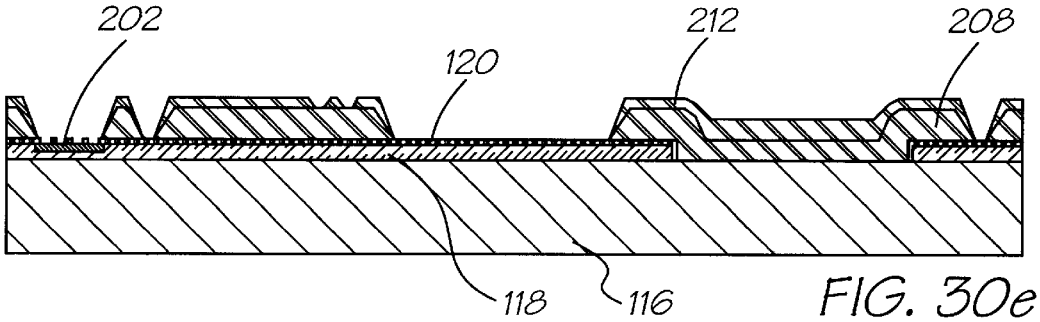
Figure 31E:
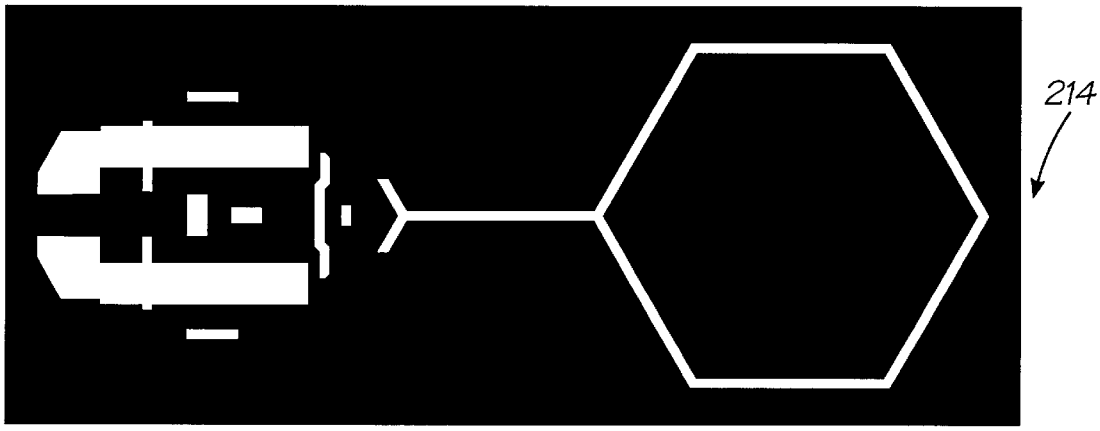
Figure 29F:
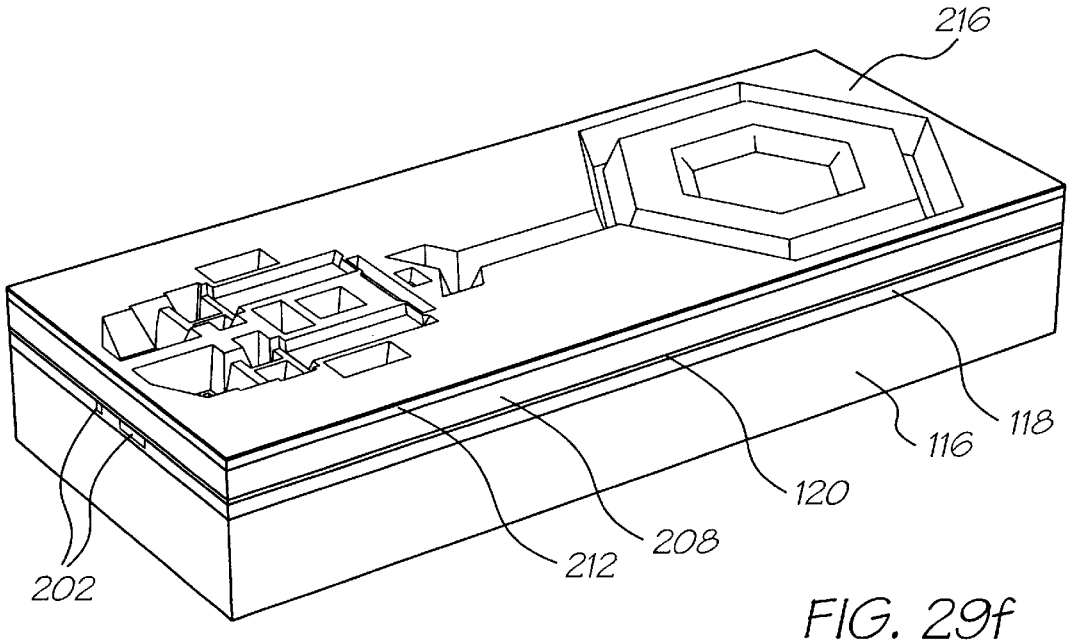
Figure 30F:
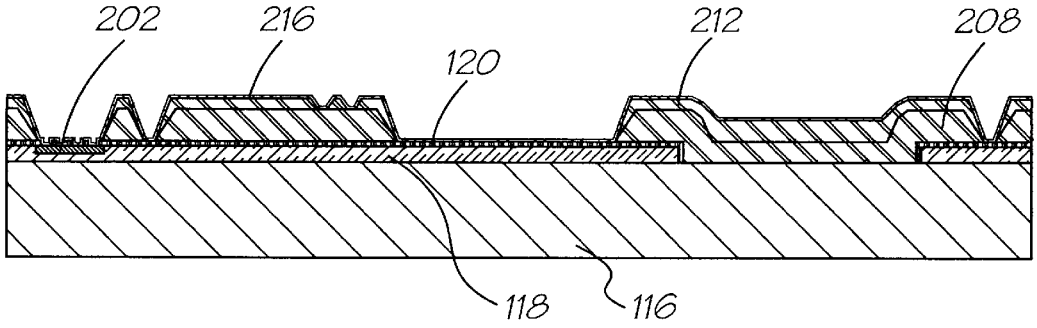
Figure 29G:
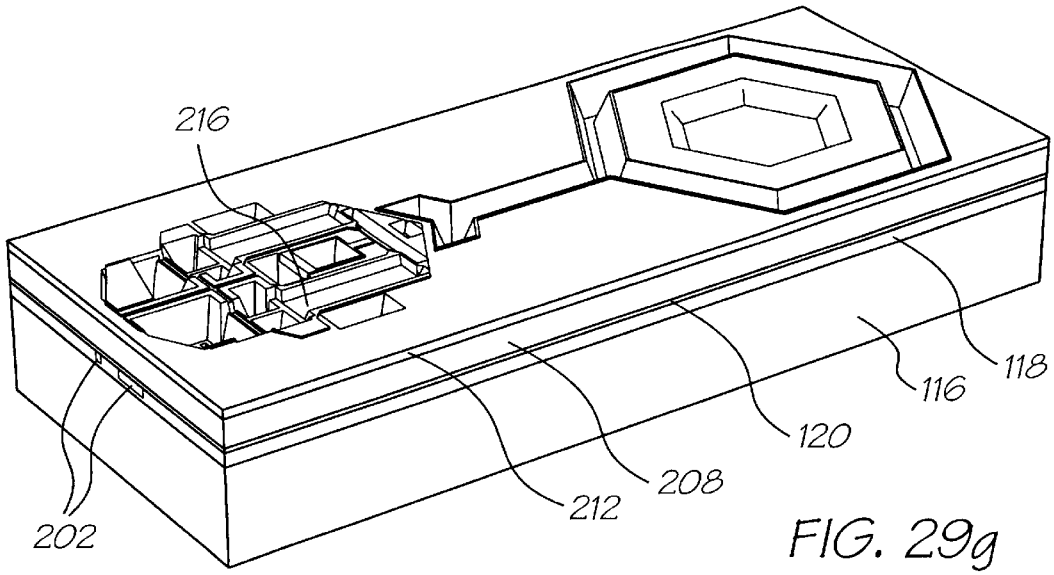
Figure 30G:
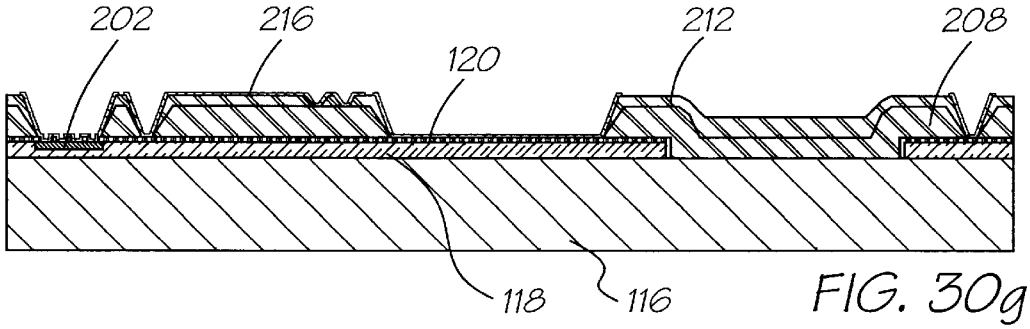
Figure 31F:
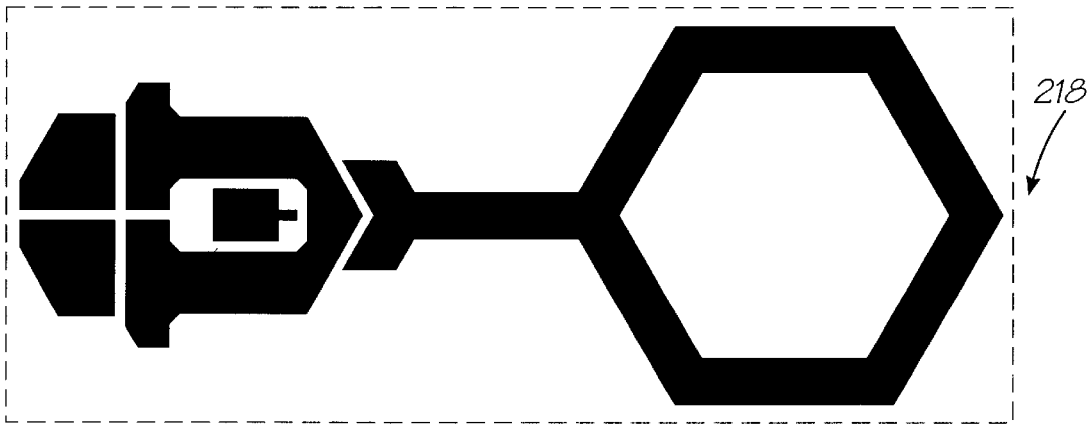
Figure 29H:
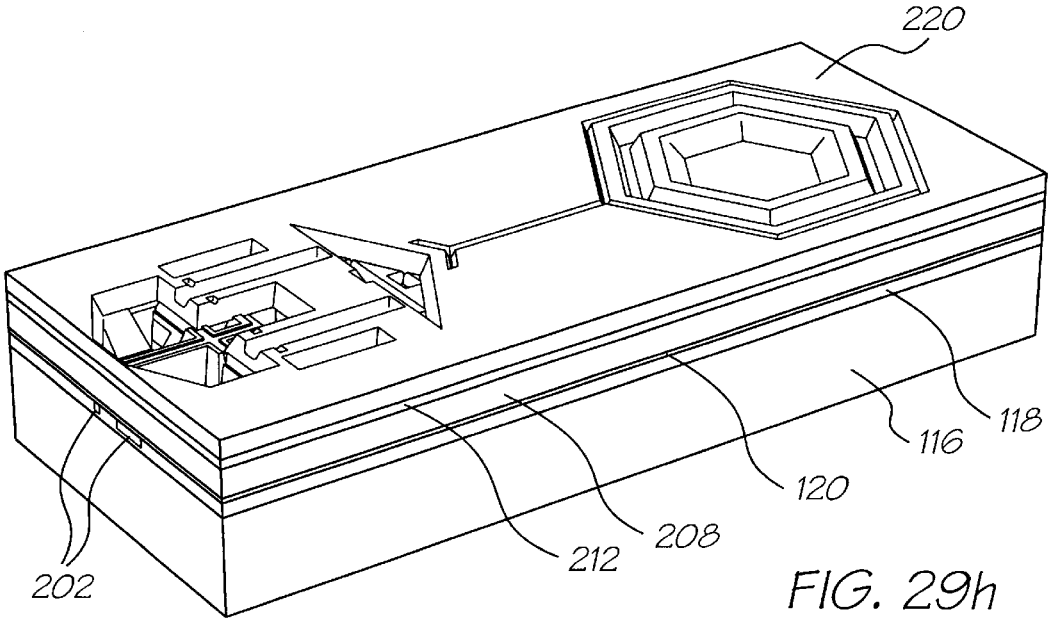
Figure 30H:
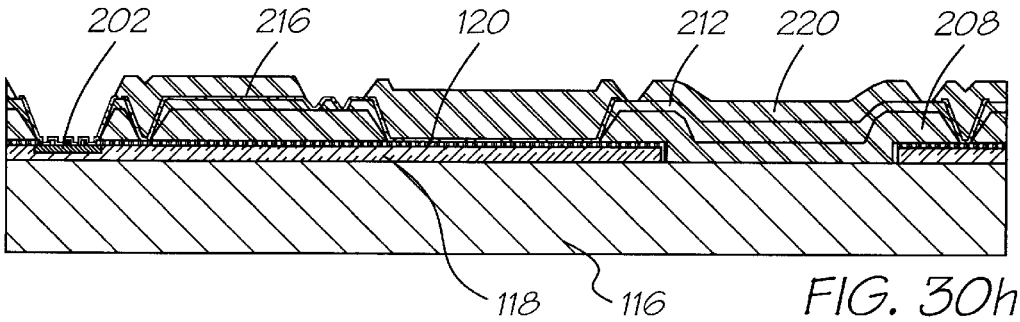
Figure 31G:
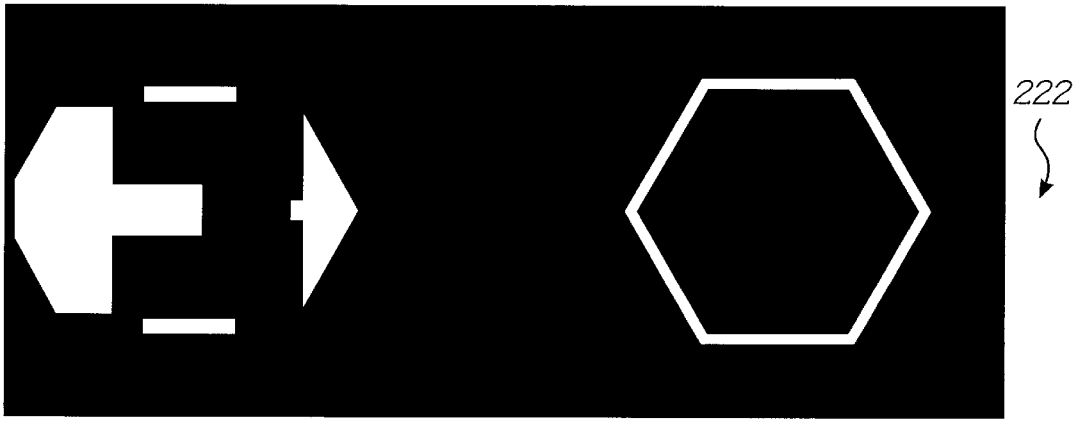
Figure 29I:
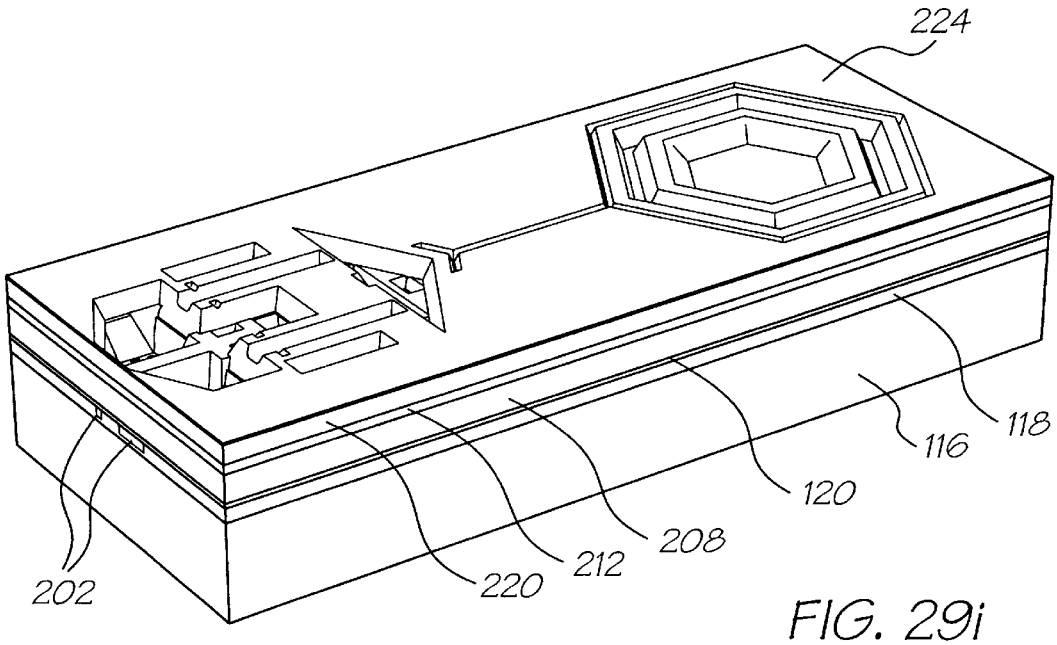
Figure 30I:
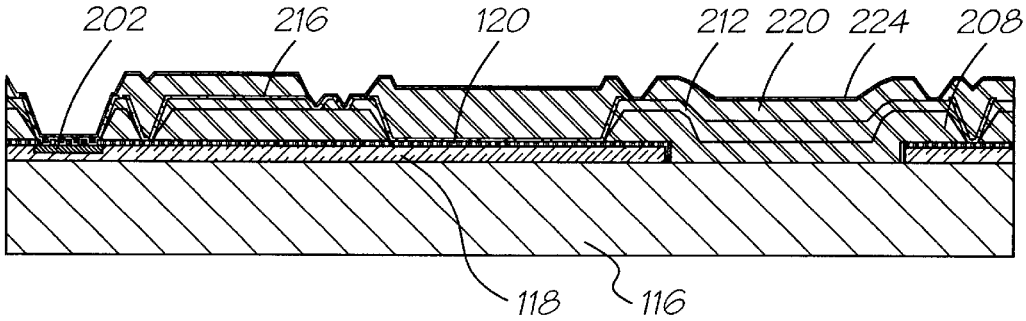
Figure 29J:
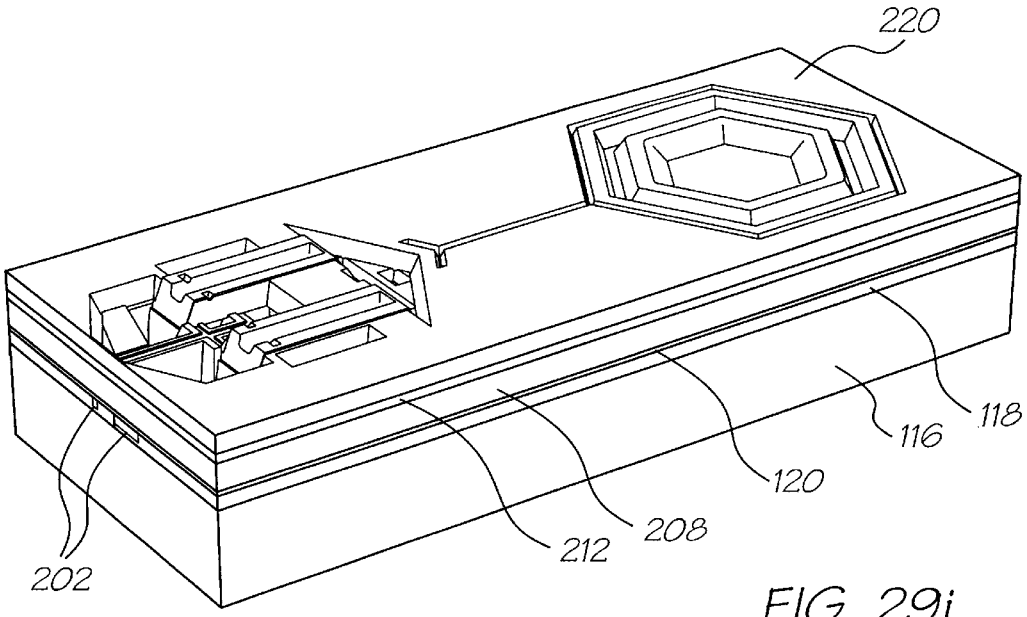
Figure 30J:
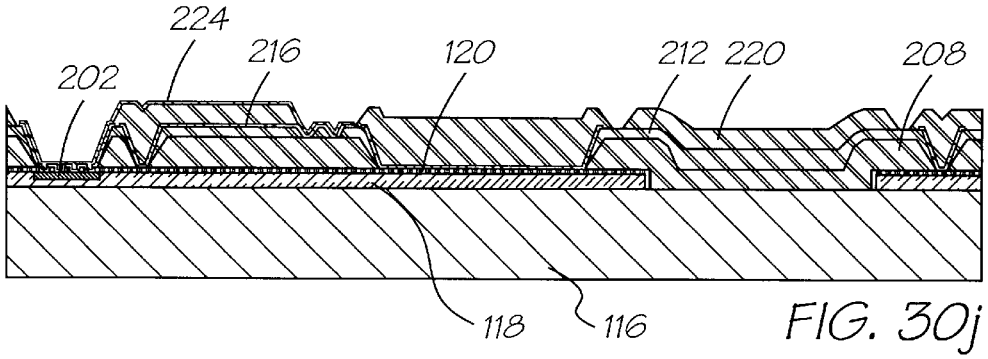
Figure 31H:
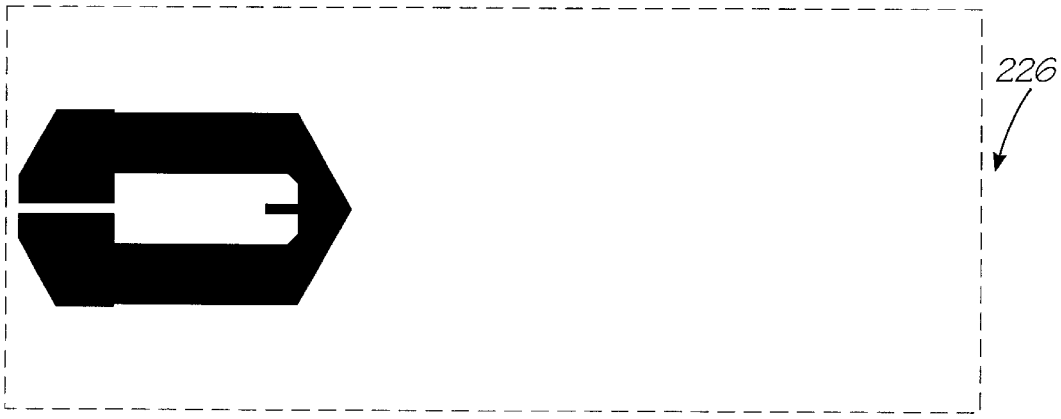
Figure 29K:
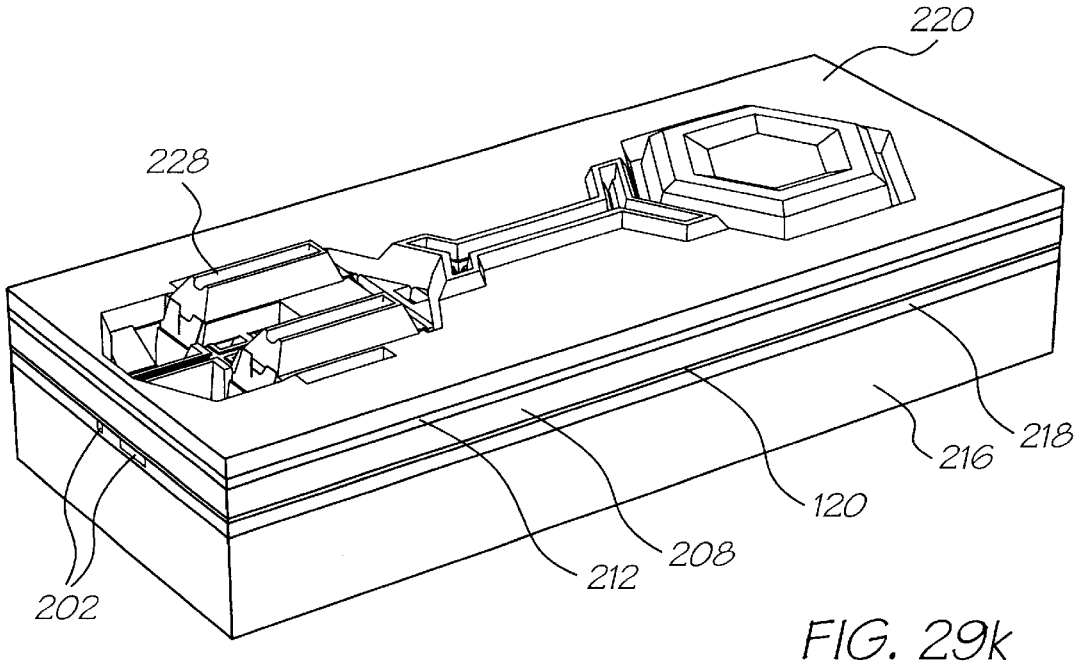
Figure 30K:
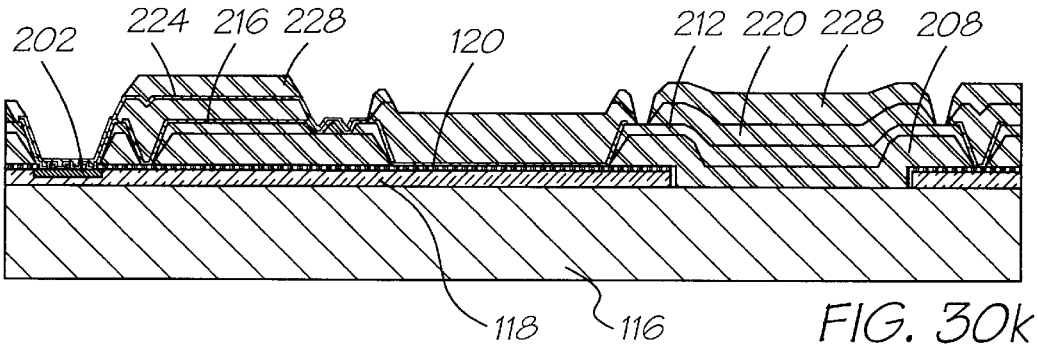
Figure 31I:
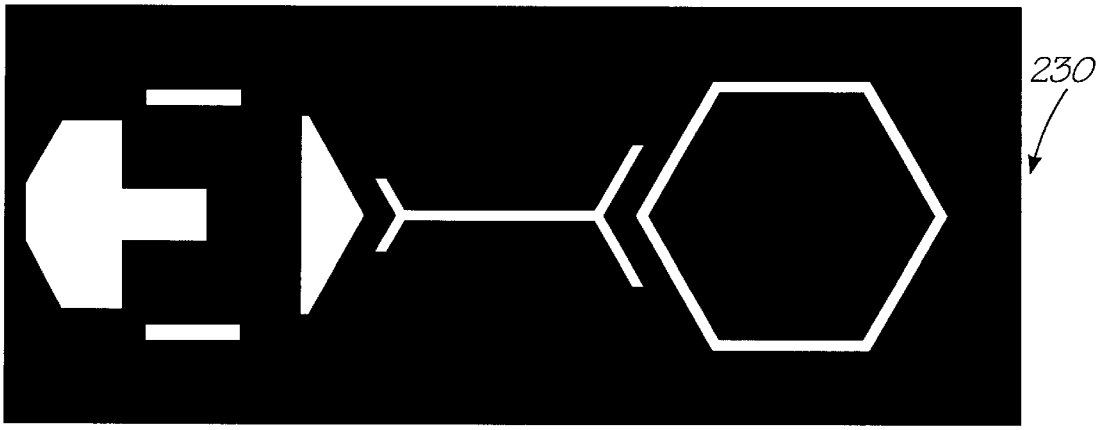

In the next step, shown in FIG. 29*e* of the drawings, a second sacrificial layer 212 is applied. The layer 212 is either 2 $\mu$m of photo-sensitive polyimide which is spun on or approximately 1.3 $\mu$m of high temperature resist. The layer 212 is softbaked and exposed to mask 214. After exposure to the mask 214, the layer 212 is developed. In the case of the layer 212 being polyimide, the layer 212 is hardbaked at 400° C. for approximately one hour. Where the layer 212 is resist, it is hardbaked at greater than 300° C. for approximately one hour.

A 0.2 micron multi-layer metal layer 216 is then deposited. Part of this layer 216 forms the passive beam 160 of the actuator 128.

The layer 216 is formed by sputtering 1,000 Å of titanium nitride (TiN) at around 300° C. followed by sputtering 50 Å of tantalum nitride (TaN). A further 1,000 Å of TiN is sputtered on followed by 50 Å of TaN and a further 1,000 Å of TiN.

Other materials which can be used instead of TiN are $TiB_2$, $MoSi_2$ or (Ti, Al)N.

The layer 216 is then exposed to mask 218, developed and plasma etched down to the layer 212 whereafter resist, applied for the layer 216, is wet stripped taking care not to remove the cured layers 208 or 212.

A third sacrificial layer 220 is applied by spinning on 4 $\mu$m of photo-sensitive polyimide or approximately 2.6. $\mu$m high temperature resist. The layer 220 is softbaked whereafter it is exposed to mask 222. The exposed layer is then developed followed by hardbaking. In the case of polyimide, the layer 220 is hardbaked at 400° C. for approximately one hour or at greater than 300° C. where the layer 220 comprises resist.

A second multi-layer metal layer 224 is applied to the layer 220. The constituents of the layer 224 are the same as the layer 216 and are applied in the same manner. It will be appreciated that both layers 216 and 224 are electrically conductive layers.

The layer 224 is exposed to mask 226 and is then developed. The layer 224 is plasma etched down to the polyimide or resist layer 220 whereafter resist applied for the layer 224 is wet stripped taking care not to remove the cured layers 208, 212 or 220. It will be noted that the remaining part of the layer 224 defines the active beam 158 of the actuator 128.

A fourth sacrificial layer 228 is applied by spinning on 4 $\mu$m of photo-sensitive polyimide or approximately 2.6 $\mu$m of high temperature resist. The layer 228 is softbaked, exposed to the mask 230 and is then developed to leave the island portions as shown in FIG. 9*k* of the drawings. The remaining portions of the layer 228 are hardbaked at 400° C. for approximately one hour in the case of polyimide or at greater than 300° C. for resist.

Figure 291:
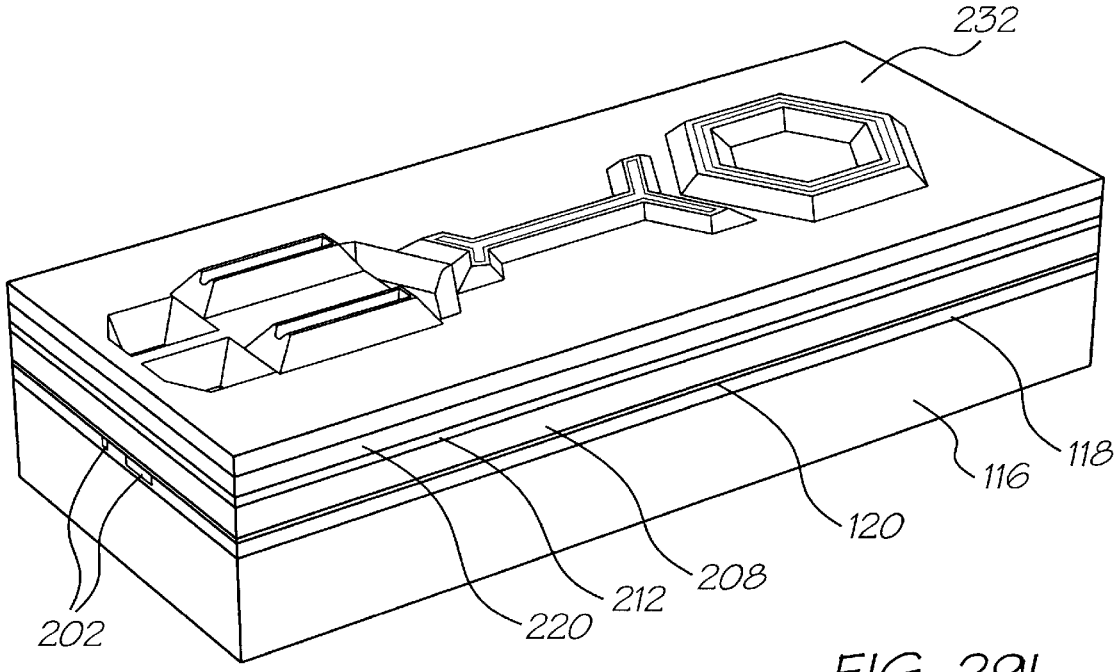
Figure 301:
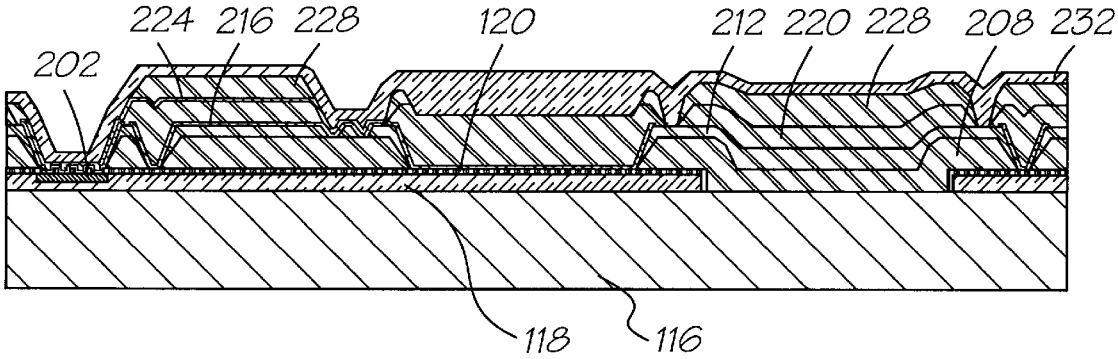
Figure 30M:
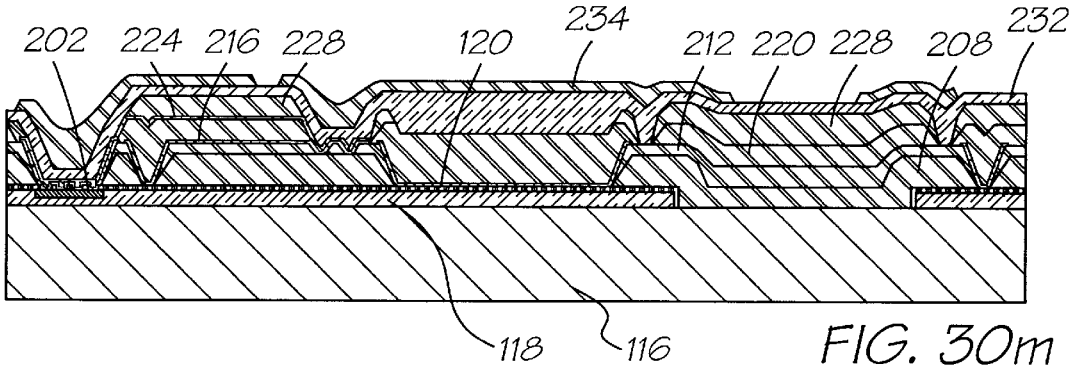
Figure 31J:
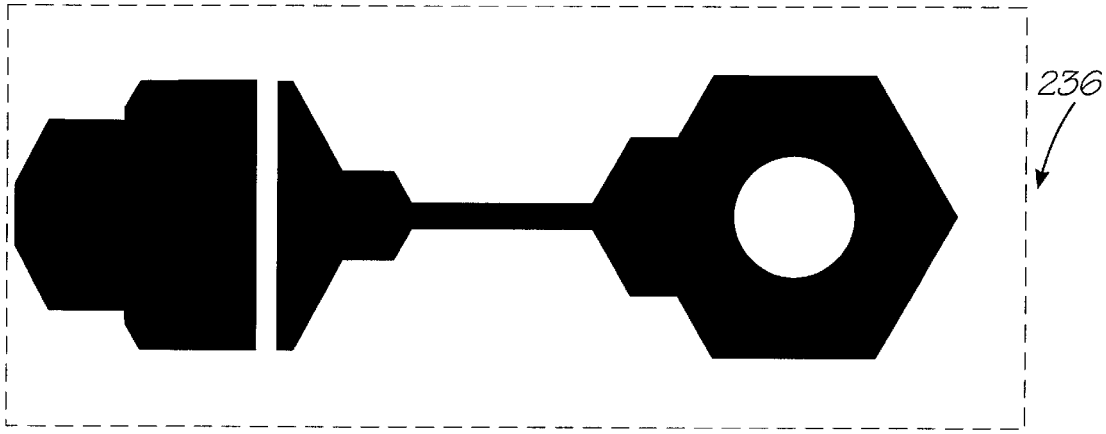
Figure 30N:
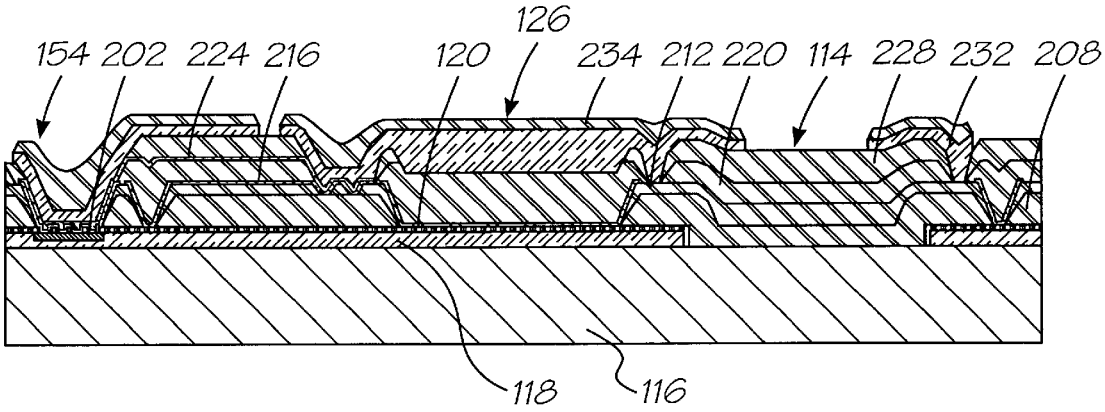
Figure 30O:
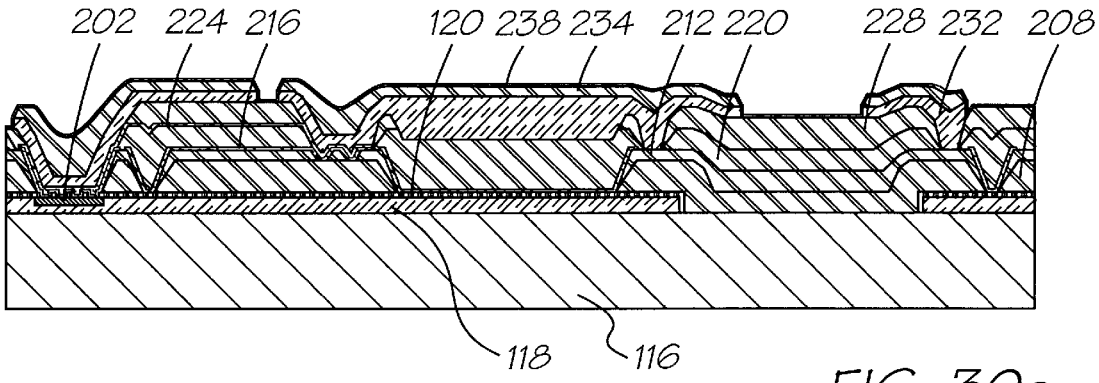

As shown in FIG. 291 of the drawing a high Young's modulus dielectric layer 232 is deposited. The layer 232 is constituted by approximately 1 $\mu$m of silicon nitride or aluminum oxide. The layer 232 is deposited at a temperature below the hardbaked temperature of the sacrificial layers 208, 212, 220, 228. The primary characteristics required for this dielectric layer 232 are a high elastic modulus, chemical inertness and good adhesion to TiN.

A fifth sacrificial layer 234 is applied by spinning on 2 $\mu$m of photo-sensitive polyimide or approximately 1.3 $\mu$m of high temperature resist. The layer 234 is softbaked, exposed to mask 236 and developed. The remaining portion of the layer 234 is then hardbaked at 400° C. for one hour in the case of the polyimide or at greater than 300° C. for the resist.

The dielectric layer 232 is plasma etched down to the sacrificial layer 228 taking care not to remove any of the sacrificial layer 234.

This step defines the nozzle opening 124, the lever arm 126 and the anchor 154 of the nozzle assembly 110.

A high Young's modulus dielectric layer 238 is deposited. This layer 238 is formed by depositing 0.2 $\mu$m of silicon nitride or aluminum nitride at a temperature below the hardbaked temperature of the sacrificial layers 208, 212, 220 and 228.

Figure 29M:
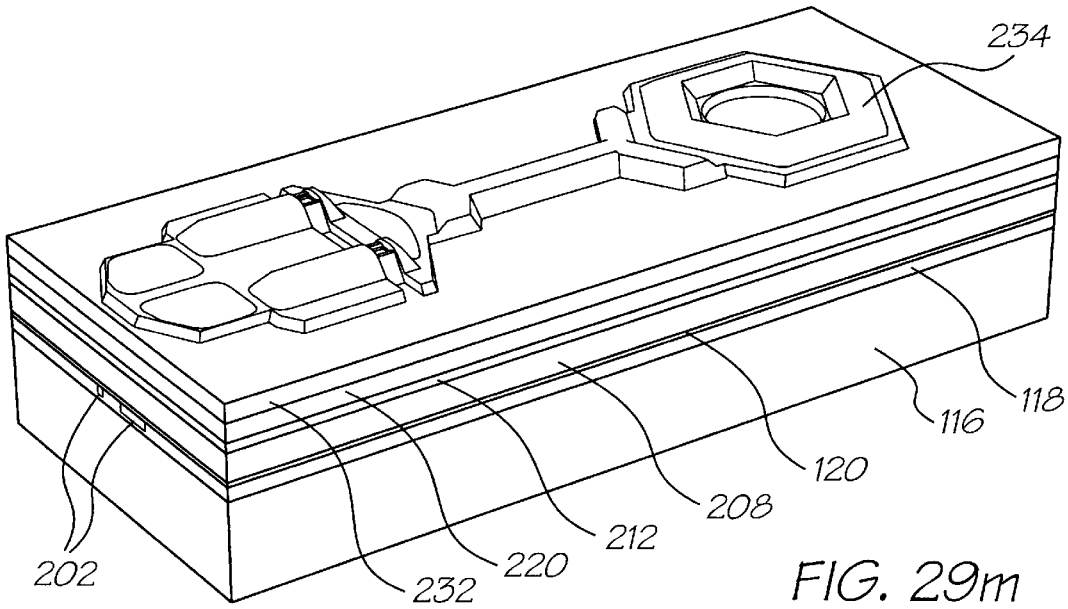
Figure 29N:
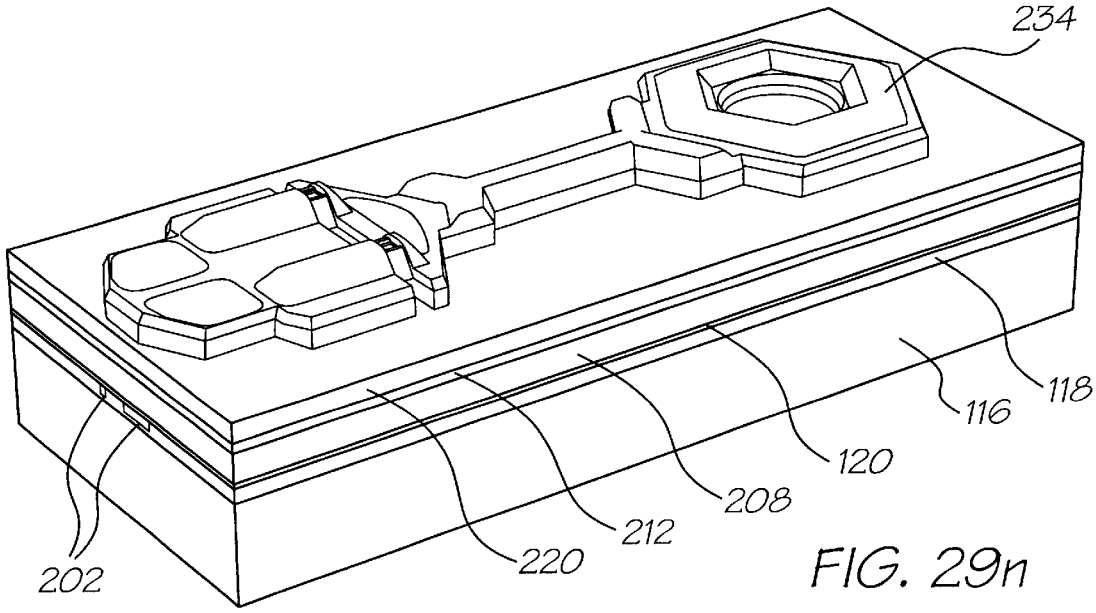
Figure 29O:
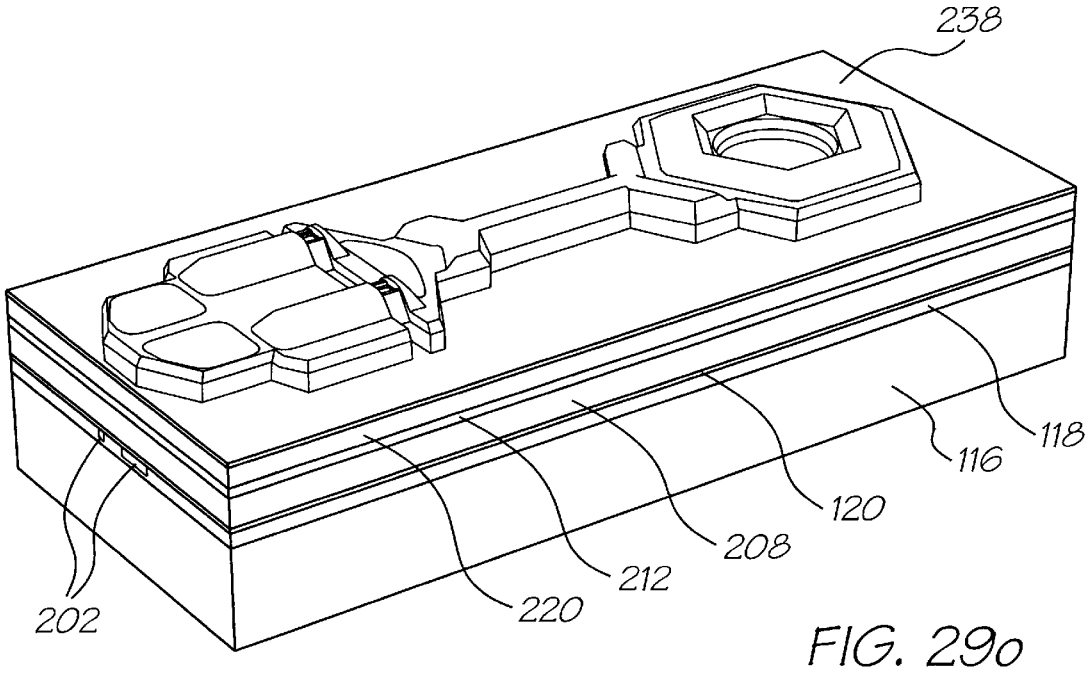
Figure 29P:
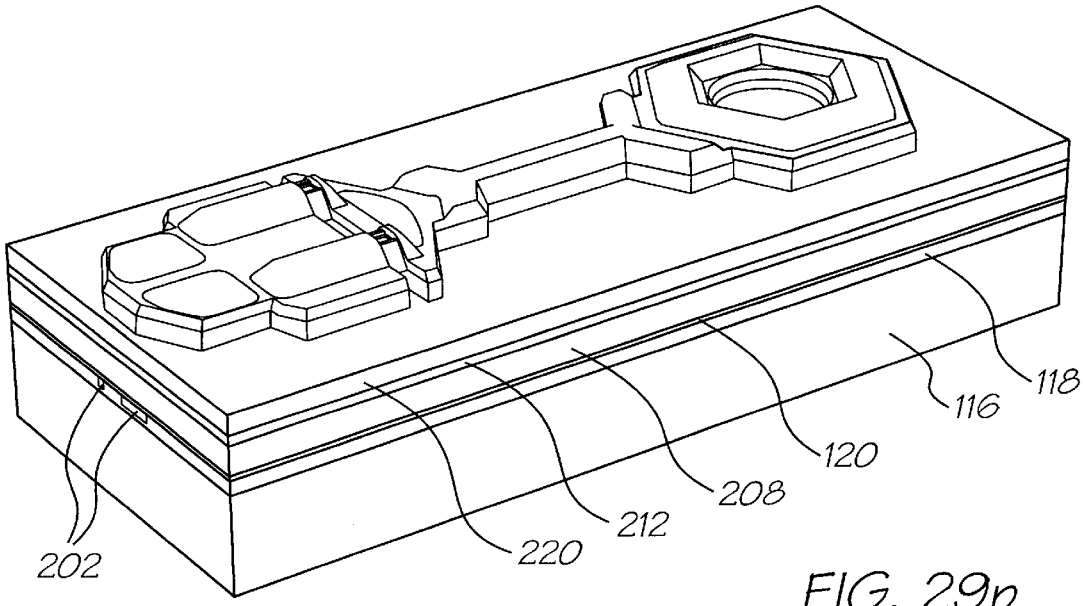
Figure 30P:
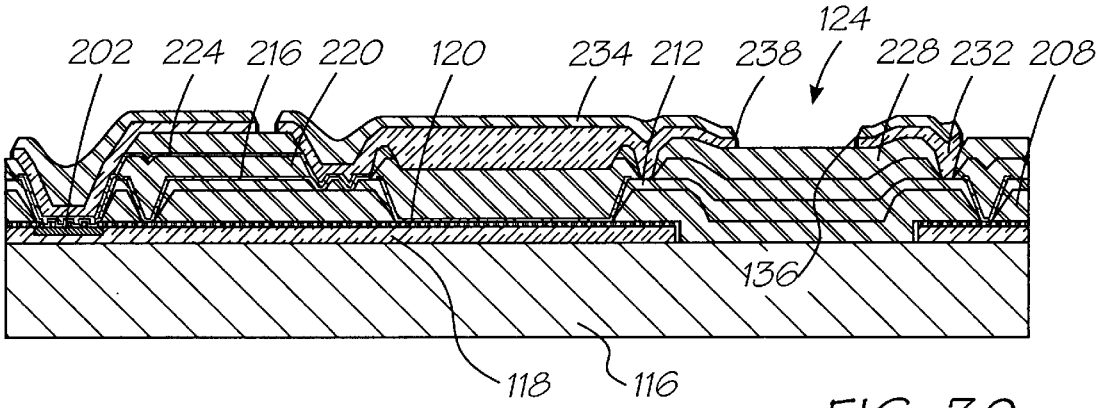
Figure 29Q:
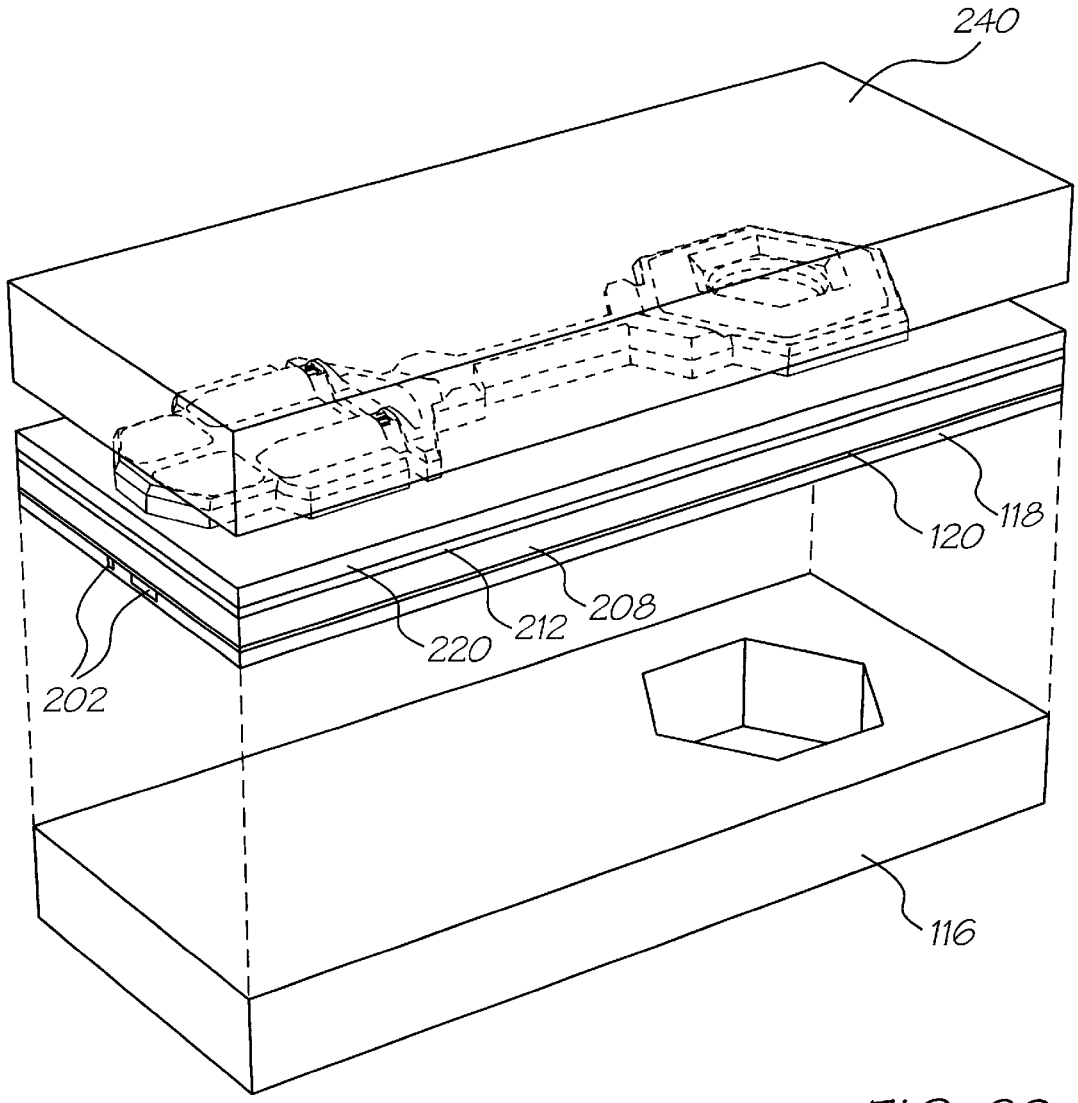

Then, as shown in FIG. 29*p* of the drawings, the layer 238 is anisotropically plasma etched to a depth of 0.35 microns. This etch is intended to clear the dielectric from all of the surface except the side walls of the dielectric layer 232 and the sacrificial layer 234. This step creates the nozzle rim 136 around the nozzle opening 124 which "pins" the meniscus of ink, as described above.

An ultraviolet (UV) release tape 240 is applied. 4 $\mu$m of resist is spun on to a rear of the silicon wafer 116. The wafer 116 is exposed to mask 242 to back etch the wafer 116 to define the ink inlet channel 148. The resist is then stripped from the wafer 116.

Figure 29R:
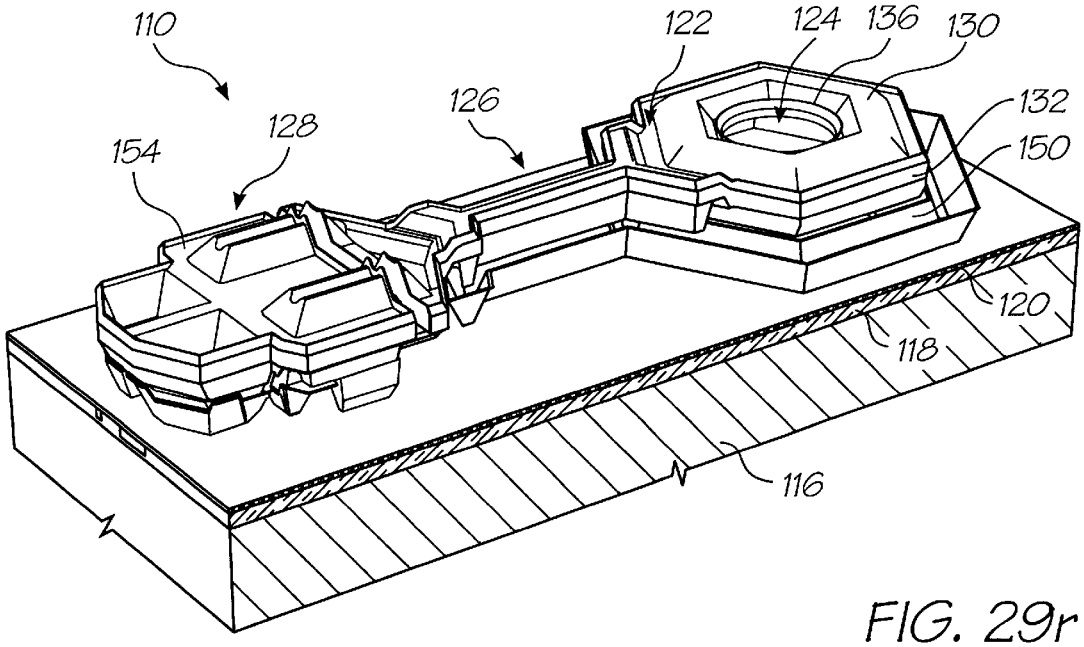
Figure 30R:
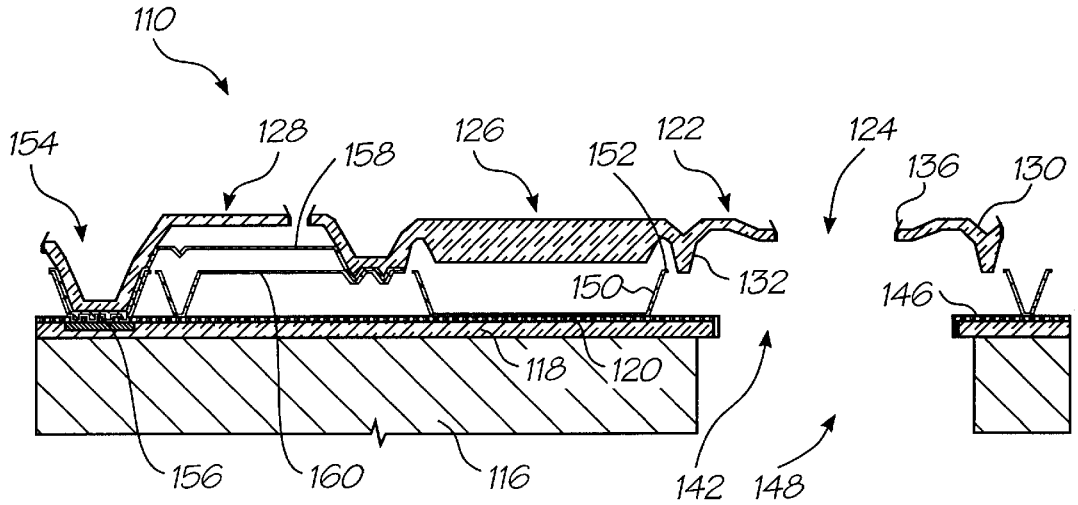
Figure 30Q:
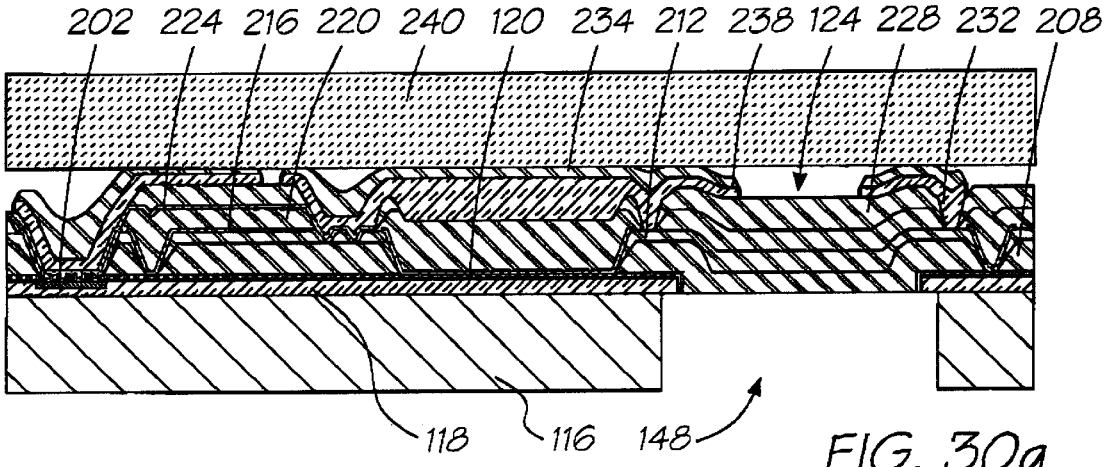
Figure 31K:
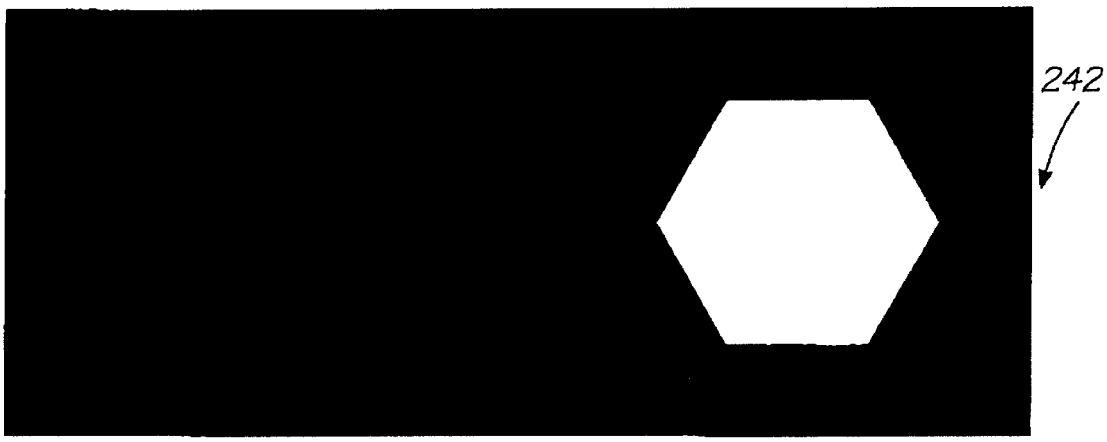
Figure 32A:
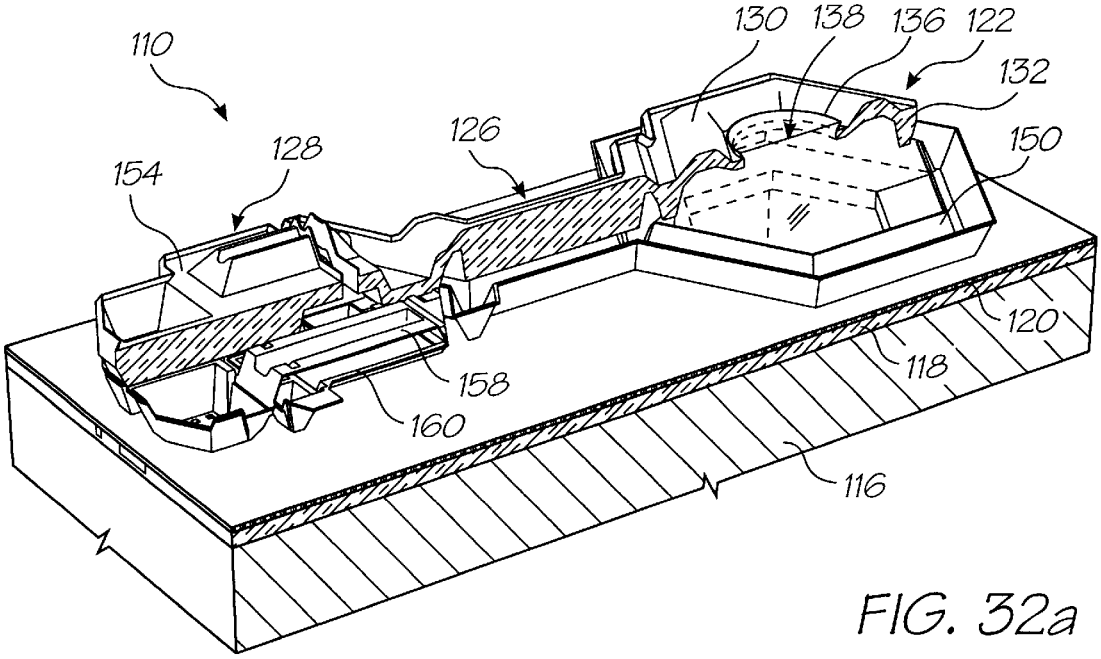
FIGS. 32*a* to 32*c* show three dimensional views of an operation of the nozzle assembly manufactured according to the method of FIGS. 29 and 30.
Figure 33A:
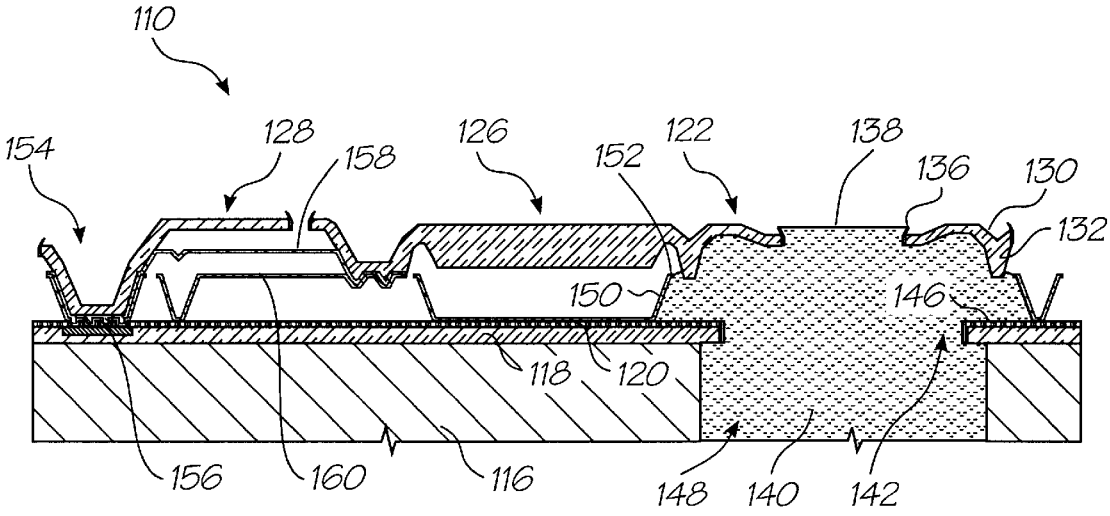
FIGS. 33*a* to 33*c* show sectional side views of an operation of the nozzle assembly manufacturetd according to the method of FIGS. 29 and 30.
Figure 32B:
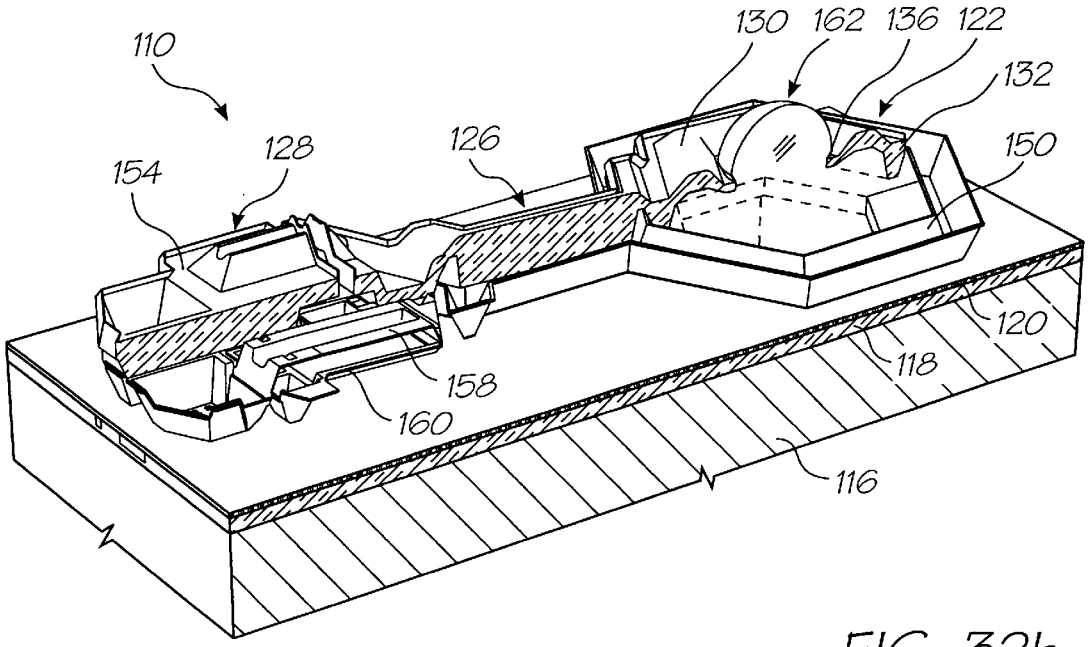
Figure 33B:
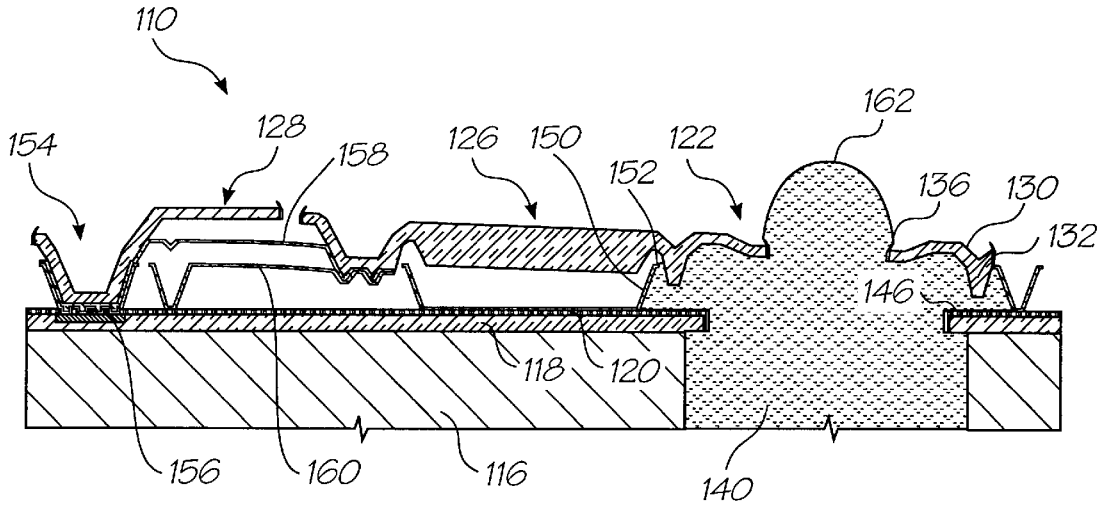
Figure 32C:
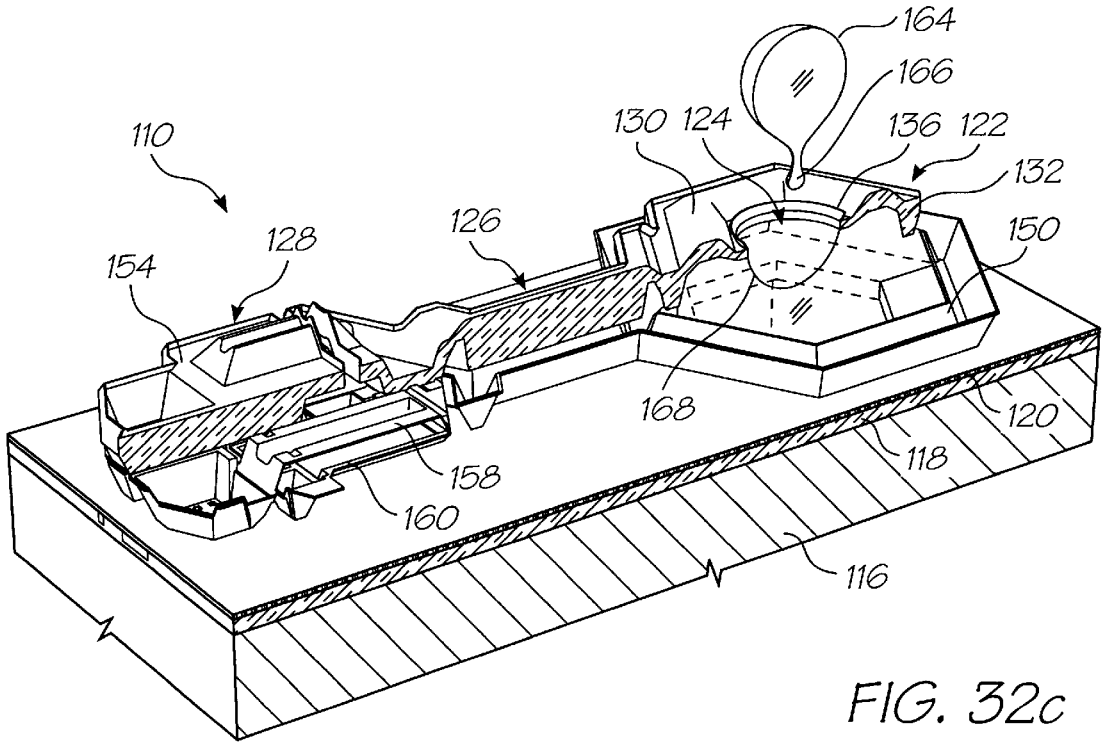
Figure 33C:
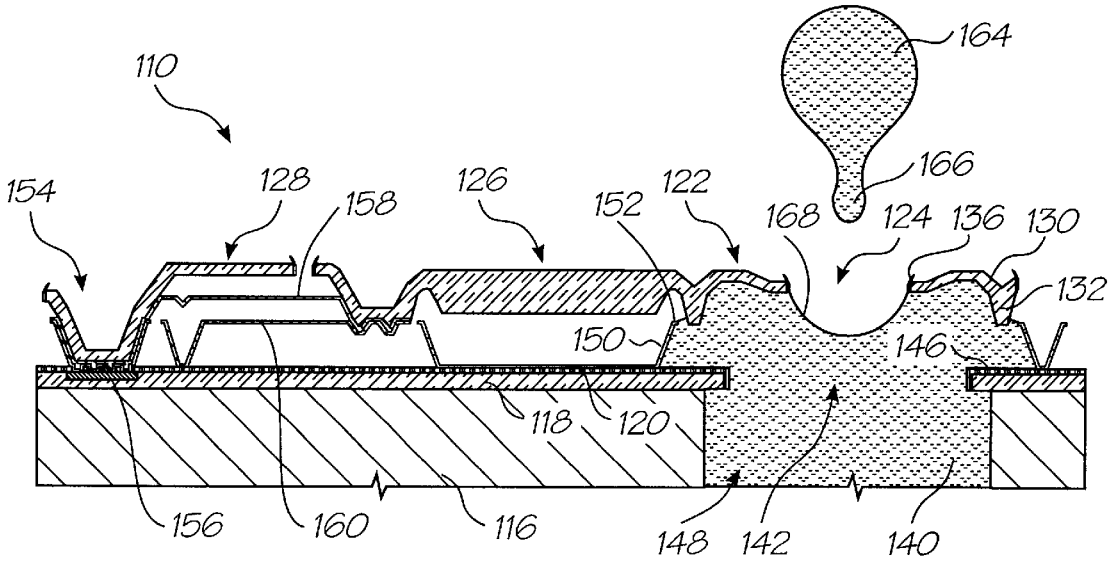

A further UV release tape (not shown) is applied to a rear of the wafer 16 and the tape 240 is removed. The sacrificial layers 208, 212, 220, 228 and 234 are stripped in oxygen plasma to provide the final nozzle assembly 110 as shown in FIGS. 29*r* and 30*r* of the drawings. For ease of reference, the reference numerals illustrated in these two drawings are the same as those in FIG. 22 of the drawings to indicate the relevant parts of the nozzle assembly 110. FIGS. 32 and 33 show the operation of the nozzle assembly 110, manufactured in accordance with the process described above with reference to FIGS. 29 and 30, and these figures correspond to FIGS. 23 to 25 of the drawings.

The presently disclosed ink jet printing technology is potentially suited to a wide range of printing system including: color and monochrome office printers, short run digital printers, high speed digital printers, offset press supplemental printers, low cost scanning printers high speed pagewidth printers, notebook computers with inbuilt pagewidth printers, portable color and monochrome printers, color and monochrome copiers, color and monochrome facsimile machines, combined printer, facsimile and copying machines, label printers, large format plotters, photograph copiers, printers for digital photographic "minilabs", video printers, PHOTO CD (PHOTO CD is a registered trademark of the Eastman Kodak Company) printers, portable printers for PDAs, wallpaper printers, indoor sign printers, billboard printers, fabric printers, camera printers and fault tolerant commercial printer arrays.

It would be appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

I claim:

1. An ink jet nozzle assembly formed on a substrate and including a nozzle chamber having a nozzle through which ink from the chamber can be ejected, the nozzle being situated on a portion of the chamber that moves relative to the substrate when the assembly is activated in use.

2. An ink jet nozzle assembly including:

a nozzle chamber having an inlet in fluid communication with an ink reservoir and a nozzle through which ink from said chamber can be ejected;

the chamber including a fixed portion and a movable portion configured such that relative movement in an ejection phase reduces an effective volume of the chamber, and alternate relative movement in a refill phase enlarges the effective volume of the chamber;

an actuator connected with the movable portion of the chamber and periodically effecting said relative movement;

the nozzle being formed in the movable portion and the inlet being positioned and dimensioned relative to the nozzle, such that ink is ejected preferentially from the chamber through the nozzle in droplet form in the ejection phase, and ink is alternately drawn preferentially into the chamber from the reservoir through the inlet in the refill phase.

3. An assembly according to claim 2 wherein the fixed portion is mounted on a substrate.

4. An assembly according to claim 3 wherein the actuator is interposed between the substrate or the fixed portion of the chamber and the movable portion of the chamber.

5. An assembly according to claim 2 including an inlet passage extending between the inlet and the ink reservoir.

6. An assembly according to claim 5 wherein the inlet passage includes flow restriction means to enhance the preferential ejection of ink from the chamber during the ejection phase in response to the relative movement of the nozzle.

7. An assembly according to claim 6 wherein the flow restriction means includes a region of reduced effective cross-sectional area relative to the chamber.

8. An assembly according to claim 6 or claim 7 wherein the flow restriction means include wall friction in the inlet passage.

9. An assembly according to claim 2 wherein the ink jet nozzle is manufactured using microelectro-mechanical-systems (MEMS) techniques.

* * * * *